US010655340B2

(12) United States Patent
Lundell et al.

(10) Patent No.: US 10,655,340 B2
(45) **Date of Patent: *May 19, 2020**

(54) PATIO BLOCKS AND BLOCK SYSTEMS WITH SIDE SURFACE POSITIONING AND RETAINING STRUCTURES

(71) Applicants: Robert John Lundell, Stillwater, MN (US); Robert A. MacDonald, Plymouth, MN (US)

(72) Inventors: Robert John Lundell, Stillwater, MN (US); Robert A. MacDonald, Plymouth, MN (US)

(73) Assignee: KEYSTONE RETAINING WALL SYSTEMS LLC, West Chester, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/527,450

(22) Filed: Jul. 31, 2019

(65) Prior Publication Data

US 2019/0352914 A1 Nov. 21, 2019

Related U.S. Application Data

(63) Continuation of application No. 15/959,817, filed on Apr. 23, 2018, now Pat. No. 10,370,859, which is a (Continued)

(51) Int. Cl.
*E04F 15/02* (2006.01)
*E04F 15/08* (2006.01)
(Continued)

(52) U.S. Cl.
CPC ..... *E04F 15/02183* (2013.01); *E01C 5/06* (2013.01); *E01C 5/14* (2013.01);
(Continued)

(58) Field of Classification Search
CPC ..... E01C 9/08; E01C 2201/16
See application file for complete search history.

(56) References Cited

U.S. PATENT DOCUMENTS 1,186,673 A * 6/1916 Mallet ..... E04F 15/04 52/592.1
1,694,665 A * 12/1928 Parker ..... E04F 13/141 52/591.2

(Continued)

FOREIGN PATENT DOCUMENTS

WO D041364-033 11/1997

OTHER PUBLICATIONS

Home Depot Harscapes Valestone Inspiration Book, Monaco Paver, pp. 6-7 (2013).

*Primary Examiner* — Abigail A Risic
(74) *Attorney, Agent, or Firm* — Popovich, Wiles & O'Connell, P.A.

(57) ABSTRACT

A landscaping block having a block body with at least a first side surface, a second side surface, a third side surface and a fourth side surface, and opposed and substantially parallel top and bottom surfaces. The patio block having at least one spacer projection extending outwardly from each of the at least first, second, third and fourth side surfaces. The patio block having at least one spacer locator positioned along each one of the first, second, third and fourth side surfaces. The at least one spacer locator positioned along each side surface has a retaining surface shaped to receive a spacer projection, at least a portion of the retaining surface extending outwardly from the side surface.

20 Claims, 19 Drawing Sheets

Related U.S. Application Data continuation of application No. 15/215,109, filed on Jul. 20, 2016, now Pat. No. 9,951,527.

(60) Provisional application No. 62/195,476, filed on Jul. 22, 2015.

(51) Int. Cl.

| | |
|---|---|
| ***E01C 5/06*** | (2006.01) |
| ***E01C 5/14*** | (2006.01) |
| ***E01C 5/20*** | (2006.01) |
| ***E01C 5/16*** | (2006.01) |

(52) U.S. Cl.

CPC ..... *E01C 5/16* (2013.01); *E01C 5/20* (2013.01); *E04F 15/08* (2013.01); *E01C 2201/02* (2013.01); *E01C 2201/06* (2013.01); *E04F 2201/022* (2013.01)

(56) References Cited

U.S. PATENT DOCUMENTS 1,794,572 A * 3/1931 Wyatt ..... C04B 28/02 52/596
3,348,459 A 10/1967 Harvey
RE27,147 E 6/1971 Harvey
3,595,140 A 7/1971 Lundin
3,873,225 A * 3/1975 Jakobsen ..... E01C 5/00 404/41
3,903,702 A * 9/1975 Appleton ..... E01C 9/004 405/20
4,067,196 A * 1/1978 Schraudenbach ..... E01C 9/004 404/36
4,440,818 A 4/1984 Buchan et al.
4,474,504 A 10/1984 Whitman et al.
4,488,833 A 12/1984 Perry et al.
4,583,341 A * 4/1986 Barth ..... E01C 5/00 52/314
4,777,777 A 10/1988 Massimo
4,823,531 A 4/1989 Labelle
D317,208 S * 5/1991 Scheiwiller ..... D25/113
5,054,957 A * 10/1991 Johnson, II ..... E01C 5/00 404/41
5,133,620 A * 7/1992 Scheiwiller ..... E01C 5/00 404/37
5,173,003 A * 12/1992 Hair ..... E01C 5/00 404/41
5,251,997 A * 10/1993 Brock ..... E01C 5/00 404/29
5,275,502 A 1/1994 Glaza et al.
5,316,408 A 5/1994 Stanley et al.
5,402,941 A 4/1995 MacLeod
5,439,171 A 8/1995 Fruend
D365,643 S * 12/1995 Wilhelm ..... D25/113
5,496,129 A * 3/1996 Dube ..... E01C 5/06 404/29
5,503,498 A * 4/1996 Scheiwiller ..... E01C 5/00 404/34
5,527,128 A 6/1996 Rope et al.
D389,926 S * 1/1998 Barth ..... D25/113
5,797,698 A * 8/1998 Barth ..... E01C 5/06 404/39
5,819,491 A 10/1998 Davis
5,862,983 A 1/1999 Andrus et al.
5,902,069 A * 5/1999 Barth ..... E01C 5/00 404/34
5,924,152 A 7/1999 Maier
D425,628 S * 5/2000 Barth ..... D25/113
D425,629 S * 5/2000 Abbrancati ..... D25/113
6,055,784 A * 5/2000 Geiger ..... E01C 5/06 404/36
D426,317 S * 6/2000 Fifield ..... D25/114
D426,648 S * 6/2000 Ogawa ..... D25/113
D434,857 S * 12/2000 Scheiwiller ..... D25/113
6,263,633 B1 * 7/2001 Hagenah ..... B28B 7/0064 404/34
6,471,440 B1 * 10/2002 Scheiwiller ..... E01C 5/06 404/39
D485,370 S * 1/2004 Schmitz ..... D25/113
D498,543 S * 11/2004 Schmitz ..... D25/113
6,843,461 B2 1/2005 Braungardt et al.
6,857,244 B2 * 2/2005 Schmitz ..... E01C 5/06 52/596
6,863,469 B2 * 3/2005 Bolduc ..... E01C 5/06 404/34
6,881,463 B2 * 4/2005 Riccobene ..... B44C 3/123 404/41
D505,733 S * 5/2005 Castonguay ..... D25/113
6,942,420 B1 * 9/2005 Drost ..... E01C 5/06 404/38
6,988,847 B2 * 1/2006 Lazar ..... E01C 5/00 404/34
D521,592 S * 5/2006 Von Langsdorff ..... D25/113
D536,058 S * 1/2007 Riccobene ..... D25/113
D537,501 S * 2/2007 Riccobene ..... D25/113
7,220,078 B2 * 5/2007 Drost ..... E01C 5/00 404/34
D547,882 S * 7/2007 Metten ..... D25/113
7,393,155 B2 * 7/2008 Riccobene ..... B44C 3/123 404/38
D586,925 S * 2/2009 Riccobene ..... D25/113
7,575,392 B2 * 8/2009 Hagenah ..... E01C 5/06 404/34
D604,431 S 11/2009 Thomassen
7,637,688 B2 * 12/2009 Riccobene ..... B44C 3/123 404/41
7,774,991 B2 8/2010 Fletcher et al.
7,850,394 B2 * 12/2010 Schroder ..... E01C 5/00 404/34
D634,859 S * 3/2011 Barkman ..... D25/113
7,934,885 B2 5/2011 Fournier
D639,454 S * 6/2011 Thomassen ..... E01C 5/06 D25/113
D656,625 S * 3/2012 MacDonald ..... D25/113
D661,409 S * 6/2012 Riccobene ..... D25/113
D663,439 S * 7/2012 Edwards ..... D25/113
D663,859 S 7/2012 Thomassen
D664,266 S * 7/2012 Thomassen ..... D25/113
D664,677 S * 7/2012 Riccobene ..... D25/113
8,336,274 B2 * 12/2012 Riccobene ..... E01C 5/00 52/604
D674,115 S * 1/2013 Merriam ..... D25/113
D674,118 S * 1/2013 MacDonald ..... D25/113
8,425,146 B2 * 4/2013 Merriam ..... E01C 5/00 404/39
D689,624 S * 9/2013 Pacitto ..... D25/113
D693,482 S * 11/2013 Merriam ..... D25/113
D701,619 S * 3/2014 Pacitto ..... D25/113
8,696,235 B2 * 4/2014 Ciccarello ..... E01C 5/06 404/38
8,763,340 B2 7/2014 Pervan et al.
8,784,002 B2 7/2014 Ringus et al.
8,820,022 B1 * 9/2014 Riccobene ..... E01C 5/06 404/34
9,315,950 B2 * 4/2016 Browning ..... E01C 5/06
D762,882 S * 8/2016 von Langsdorff ..... D25/152
D783,862 S * 4/2017 Von Langsdorff ..... D25/113
D789,555 S * 6/2017 Lundell ..... D25/113
D789,556 S * 6/2017 Lundell ..... D25/113
D791,345 S * 7/2017 Lundell ..... D25/112
D819,231 S * 5/2018 Lundell ..... D25/113
D824,542 S * 7/2018 Lundell ..... D25/113
10,081,918 B2 * 9/2018 Browning ..... E01C 5/06
2002/0170259 A1 11/2002 Ferris
2003/0007834 A1 * 1/2003 Bolduc ..... E01C 5/06 404/41
2004/0175233 A1 9/2004 Beamish et al.
2005/0223666 A1 10/2005 Forster et al.
2007/0077387 A1 * 4/2007 Riccobene ..... B44C 3/123 428/44

(56) References Cited

U.S. PATENT DOCUMENTS

| | | | | |
|---|---|---|---|---|
| 2008/0101860 | A1* | 5/2008 | Scheiwiller | E01C 5/00 404/42 |
| 2008/0282638 | A1 | 11/2008 | Douglass | |
| 2009/0097916 | A1* | 4/2009 | Schroder | E01C 5/00 404/41 |
| 2013/0302088 | A1* | 11/2013 | Penshorn | E01C 5/06 404/41 |
| 2014/0112715 | A1* | 4/2014 | Browning | E01C 5/06 404/41 |
| 2014/0169878 | A1* | 6/2014 | MacDonald | E01C 5/003 404/41 |
| 2014/0270946 | A1 | 9/2014 | Bradsen | |
| 2016/0017547 | A1 | 1/2016 | Bordelon et al. | |

* cited by examiner

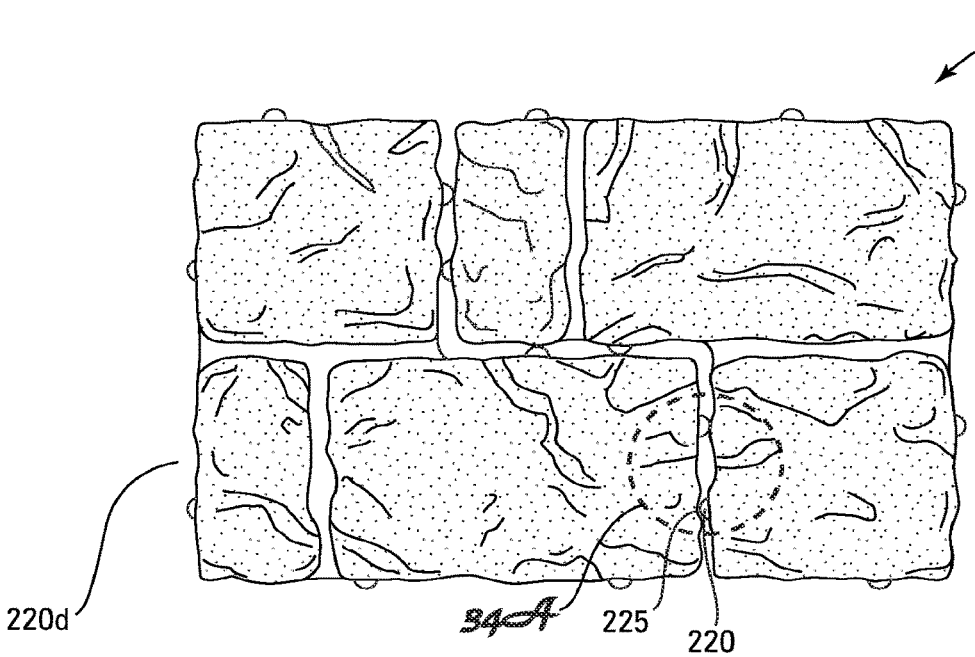
Fig. 34
Fig. 34A
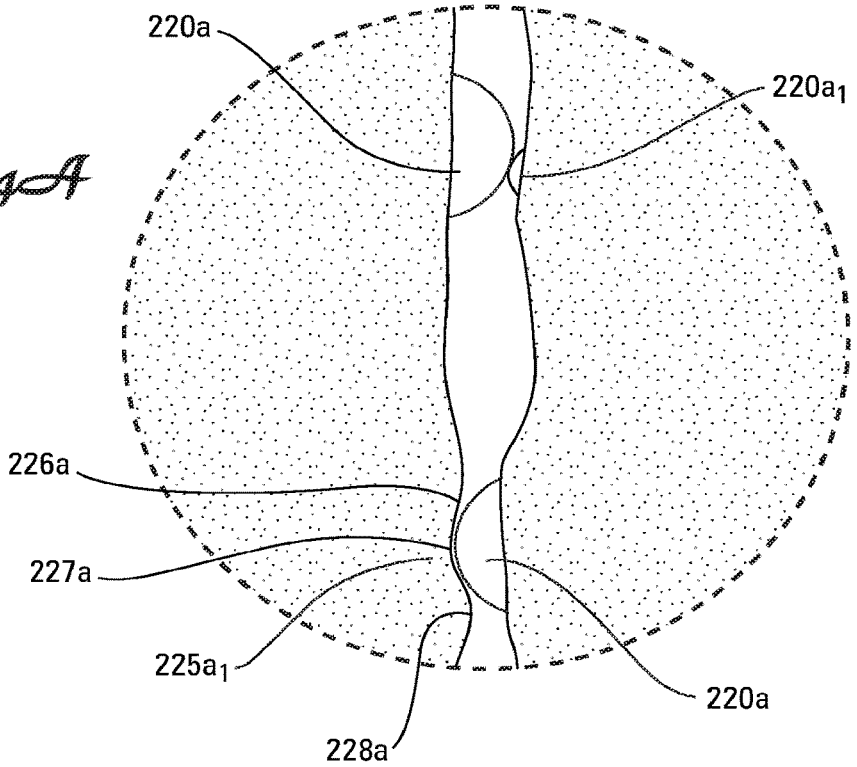

PATIO BLOCKS AND BLOCK SYSTEMS WITH SIDE SURFACE POSITIONING AND RETAINING STRUCTURES

This application is a continuation of U.S. Ser. No. 15/959,817, filed Apr. 23, 2018, which is a continuation of U.S. Ser. No. 15/215,109, filed Jul. 20, 2016, which claims the benefit of U.S. Provisional Application No. 62/195,476, filed Jul. 22, 2015, the contents of each of which are hereby incorporated by reference herein.

FIELD OF THE INVENTION

This invention relates generally to patio blocks, paver blocks, landscaping blocks and block systems having side surface guidance, positioning and retaining structures. This invention also relates to patios and the like and methods of constructing patios and the like with blocks having side surface guidance, positioning and retaining structures.

BACKGROUND OF THE INVENTION

Patio, paver and landscaping blocks are used in various landscaping projects and are available in a wide variety of styles. Numerous methods and materials exist for the construction of patios, walkways, driveways, roadways and the like. In recent years, segmental concrete patio, paver and landscaping units, which may be laid, positioned or dry stacked without the use of mortar or other complex securing means, have become widely accepted in the construction of patios, walkways, driveways, roadways and the like. Such patio, paver and landscaping units have gained popularity because they are mass produced and, consequently, relatively inexpensive. They are structurally sound, easy and relatively inexpensive to install, and couple the durability of concrete with the attractiveness of various architectural finishes.

In the manufacture of patio, paver and landscaping blocks and other kinds of blocks made from concrete, it is common to use a mold that forms a block module which is then split to form two or more blocks. Another method is wherein blocks are individually formed in a mold and the surfaces are textured by removal of the mold. Another known method of creating a block having an irregular, textured or patterned surface is to form the block in a mold box that has been provided with a top shoe and/or sidewall liner shaped to impart the textured or patterned surface on the top surface and/or side surfaces of the block during the block molding process.

In the construction of a patio, walkway, driveway or roadway, the aesthetic design of the individual block units and the overall visually pleasing aesthetic appearance of the constructed structure is important. Blocks that have a desirable texture or pattern create an exposed surface of a patio, walkway, driveway and roadway that is visually appealing. Additionally, in the construction of a patio, walkway, driveway or roadway, the functionality of the individual block units and the overall ease/difficulty in constructing the structure is important. Blocks that have high functionality and are user friendly allow greater ease in constructing a structure and, as such, are desirable.

It would be desirable to provide a patio, paver or landscaping block with a textured or patterned exposed surface with multiple areas separated by a false joint for use in constructing a patio, walkway, driveway or the like. It would be further desirable to provide a block with a textured pattern or textured surface with multiple areas separated by false joints that could create multiple desirable and aesthetic designs in an exposed surface of a patio, walkway, driveway or the like.

It would be desirable to provide a patio, paver or landscaping block having a side surface with guiding and retaining structures that would allow adjacent blocks positioned in the construction of a structure to be guided into a desired position and retained in the desired position.

It would further be desirable to provide a patio, paver or landscaping block with a side surface having an outward extending spacer projection and a spacer locator that is sized and shaped to accept the spacer projection such that during the construction of a structure, the spacer projections of the side surface of a first blocks are guided into and retained by the spacer locators of the side surface of an adjacent second block preventing slippage, pavement movement and shifting of the side surface of the first block relative to the side surface of the second adjacent block and provide proper and correct alignment of a block relative to adjacently positioned blocks.

It would further be desirable to provide a patio, paver or landscaping block with a side surface having an outward extending spacer projection and a spacer locator that is sized and shaped to accept the spacer projection such that during the construction of a structure, the spacer projections and spacer locators of the side surface of a first block and the spacer projections and spacer locators of the side surface of an adjacent second block are positioned on each side surface such that the top surface of the first patio block is spaced a desired and consistent distance from the top surface of the second adjacent block.

It would further be desirable to provide a patio, paver or landscaping block with an irregularly contoured or non-planar side surface having an outward extending spacer projection and a spacer locator that is sized and shaped to accept the spacer projection such that during the construction of a structure, the spacer projections and spacer locators of the side surface of a first block and the spacer projections and spacer locators of the side surface of an adjacent second block are positioned on each side surface such that the top surface of the first block has a variable or inconsistently spaced gap or distance that is predetermined and within a desired length range from the top surface of the second adjacent block, giving the patio a more natural, visually desirable aesthetic.

It would further be desirable to provide a patio, paver or landscaping block having spacer projections and spacer locators on the side surfaces of adjacently positioned blocks that provide a void or space between the blocks for the permeation of water/moisture, and the like, to pass or flow from the top surface of the block to the ground below. It would be further desirable to provide a patio, paver or landscaping block having irregularly contoured side surfaces such that when the bocks are positioned adjacent to one another, the blocks would be prevented from aligning completely and abutting one another, ensuring that spaces or voids in the joints between the blocks would be maintained throughout any completed structure made with the blocks.

SUMMARY OF THE INVENTION

A patio block including a block body having at least a first side surface, a second side surface, a third side surface and a fourth side surface, and opposed and substantially parallel top and bottom surfaces, each side surface having a height extending from the bottom surface to the top surface, each of the side surfaces having at least one spacer projection extending outwardly from the side surface and at least one spacer locator. The patio block including that the at least one spacer locator of each side surface has a first and second exposed surface, the first and second exposed surface extending outward from the side surface and a retaining surface extending inwardly from the first and second exposed surface toward the block body, the retaining surface of each spacer locator being shaped to receive a spacer projection.

A patio system including a plurality of patio blocks, the patio blocks having a block body with at least a first side surface, a second side surface, a third side surface and a fourth side surface, and opposed and substantially parallel top and bottom surfaces, each side surface having a height extending from the bottom surface to the top surface, each of the side surfaces having at least one spacer projection extending outwardly from the side surface and at least one spacer locator, the at least one spacer locator of each side surface having a first and second exposed surface, the first and second exposed surface extending outwardly from the side surface and a retaining surface extending inwardly from the first and second exposed surface toward the block body, the retaining surface of each spacer locator being shaped to receive a spacer projection. The patio system further including that when a patio is made with the plurality of patio blocks, the at least one spacer locator receives a spacer projection such that when a side surface of a first patio block is laid adjacent to a side surface of a second patio block the spacer projection of the side surface of the first patio block is accepted and retained into the spacer locator of the second patio block preventing displacement of the first patio block relative to the adjacent second patio block.

A method of making a patio including providing a plurality of patio blocks, the patio blocks having a block body with at least a first side surface, a second side surface, a third side surface and a fourth side surface, and opposed and substantially parallel top and bottom surfaces, each side surface having a height extending from the bottom surface to the top surface, each of the side surfaces having at least one spacer projection extending outwardly from the side surface and at least one spacer locator, the at least one spacer locator of each side surface having a first and second exposed surface, the first and second exposed surface extending outward from the side surface and a retaining surface extending inwardly from the first and second exposed surface toward the block body, the retaining surface of each spacer locator being shaped to receive a spacer projection. The method including forming a patio by positioning the patio blocks with a side surface of a first patio block laid adjacent to a side surface of a second patio block such that the at least one spacer projection of the side surface of the first patio block is accepted and retained into the at least one spacer locator of the second adjacent patio block preventing displacement of the first patio block relative to the adjacent second patio block.

A patio block including a block body having opposed top and bottom surfaces, and at least a first side surface, a second side surface, a third side surface and a fourth side surface, each of the at least first, second, third and fourth side surfaces extending from the top surface to the bottom surface. The patio block including at least one spacer projection positioned along each one of the at least first, second, third and fourth side surfaces, the at least one spacer projection extending outwardly from the at least first, second, third and fourth side surfaces and at least one spacer locator positioned along each one of the at least first, second, third and fourth side surfaces. The patio block including that the at least one spacer locator has a first and second exposed surface and a retaining surface, the retaining surface extending from the first exposed surface to the second exposed surface and having a contour shaped to receive a spacer projection, at least a portion of at least one of the first and second exposed surfaces extends outward from the side surface and block body and at least a portion of the contour of the retaining surface extends outside/beyond the side surface and the block body.

The patio block may include that the at least one spacer projection of each side surface extends a partial height of the side surface from the bottom surface toward the top surface of the patio block. The patio block may further include that the at least one spacer locator of each side surface extends the entire height of the side surface from the bottom surface to the top surface of the patio block.

The patio block may include that the entire contour of the retaining surface of the spacer locator of each side surface extends outside of the side surface and is located outside of the block body. The patio block may include that a portion of the contour of the retaining surface of the spacer locator of each side surface extends outside of the side surface and block body and a portion of the contour of the retaining surface of the spacer locator extends through the side surface and into the block body. The patio block may further include that the entire contour of the retaining surface of the spacer locator of at least one of the first, second, third and fourth side surfaces extends outside of the side surface and is located outside of the block body and the contour of the retaining surface of the spacer locator of at least one of the other of the at least first, second, third and fourth side surfaces has a portion that extends outside of the side surface and block body and a portion that extends through the side surface and into the block body.

The patio block may include that each side surface has a vertical plane and a portion of the contour of the retaining surface of the at least one spacer locator is in the same vertical plane as the side surface. The patio block may include that the block body has a fifth and sixth side surface such that the block body has an "L" shape, wherein the patio block has at least one spacer projection positioned along the fifth and sixth side surface and at least one spacer locator positioned along the fifth and sixth side surfaces.

A patio system including a plurality of patio blocks, the patio blocks having a block body with opposed top and bottom surfaces, and at least a first side surface, a second side surface, a third side surface and a fourth side surface each extending from the top surface to the bottom surface, each of the at least first, second, third and fourth side surfaces having an irregular contour such that top and bottom edges along the top and bottom surfaces where the at least first, second, third and fourth side surfaces extend also have an irregular contour, at least one spacer projection extending outwardly from each of the at least first, second, third and fourth side surfaces and at least one spacer locator positioned along each one of the first, second, third and fourth side surfaces, the at least one spacer locator positioned along each side surface having a retaining surface shaped to receive a spacer projection, at least a portion of the retaining surface extending outwardly from the side surface. The patio system including that when a patio is made with the plurality of patio blocks, the at least one spacer locator receives a spacer projection such that when a side surface of a first patio block is laid adjacent to a side surface of a second patio block the spacer projection of the side surface of the first patio block is accepted and retained into the spacer locator of the second patio block preventing displacement of the first patio block relative to the adjacent second patio block and creating a joint between the first patio block and the second patio block, the joint having variable widths along the length of the adjacent portions of the irregularly contoured top edges of the first and second patio block.

The patio system may include that the at least one spacer locator of at least one of the at least first, second, third and fourth side surfaces is at least two spacer locators, one of the spacer locators being of a first type having an entire retaining surface located outside of the block body and one of the spacer locators being of a second type having only a portion of a retaining surface located outside of the block body.

A method of making a patio including providing a plurality of patio blocks, the patio blocks having a block body with opposed top and bottom surfaces, and at least a first side surface, a second side surface, a third side surface and a fourth side surface each extending from the top surface to the bottom surface, each of the at least first, second, third and fourth side surfaces having an irregular contour such that top and bottom edges along the top and bottom surfaces where the at least first, second, third and fourth side surfaces extend also have an irregular contour, at least one spacer projection extending outwardly from each of the at least first, second, third and fourth side surfaces and at least one spacer locator positioned along each one of the first, second, third and fourth side surfaces, the at least one spacer locator positioned along each side surface having a retaining surface shaped to receive a spacer projection, at least a portion of the retaining surface extending outwardly from the side surface. The method including forming a patio by positioning the patio blocks with a side surface of a first patio block laid adjacent to a side surface of a second patio block such that the at least one spacer projection of the side surface of the first patio block is accepted and retained into the at least one spacer locator of the second adjacent patio block preventing displacement of the first patio block relative to the adjacent second patio block and creating a joint between the first patio block and the second patio block that has a width, the width of the joint having variable dimensions along the length of the adjacent portions of the irregularly contoured top edges of the first and second patio block.

BRIEF DESCRIPTION OF THE DRAWINGS

The present invention will now be described by way of example with reference to the accompanying drawings, wherein:

FIG. 34 is a top views of embodiments of the block of FIGS. 14 to 20 positioned adjacently to one another in a portion of a patio.

FIGS. 34A to 34G are exploded views of a portion of FIG. 34 showing alternate embodiments of spacer projections and spacer locators for the blocks of the present invention.

DETAILED DESCRIPTION OF THE PREFERRED EMBODIMENTS

Figure 1:
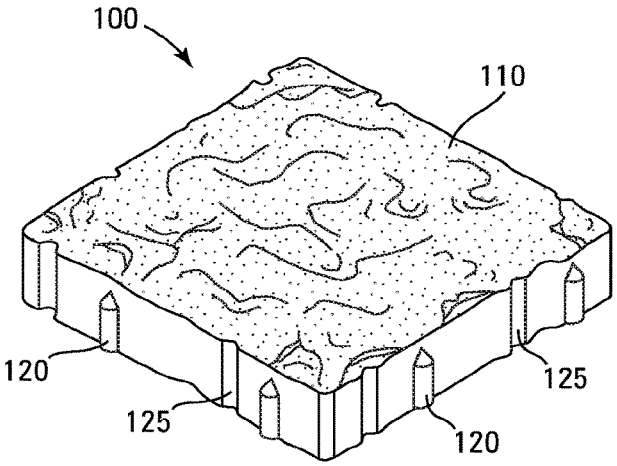
FIGS. 1 to 7 are top perspective, top, bottom and side views, respectively, of an embodiment of a landscaping block.
Figure 2:
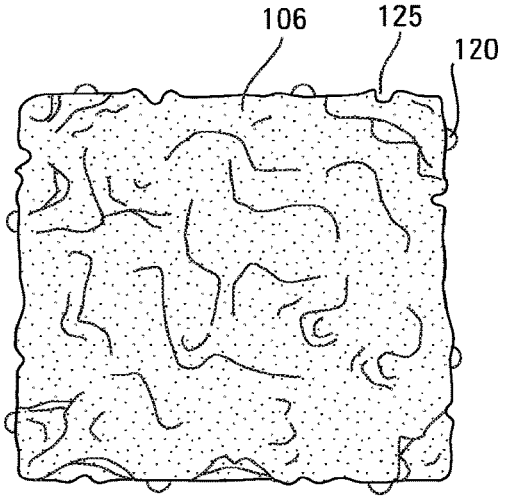
Figure 4:
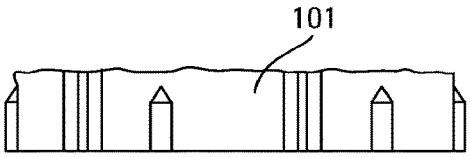
Figure 5:
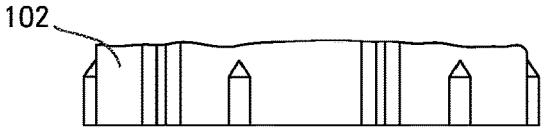
Figure 6:
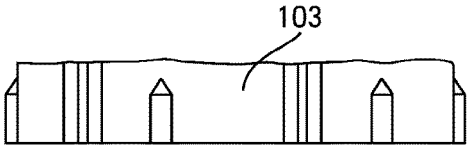
Figure 7:
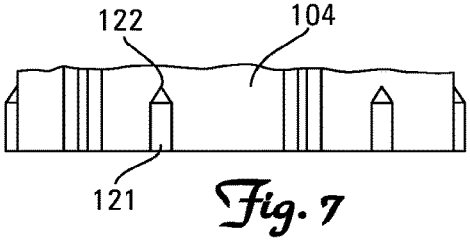
Figure 3:
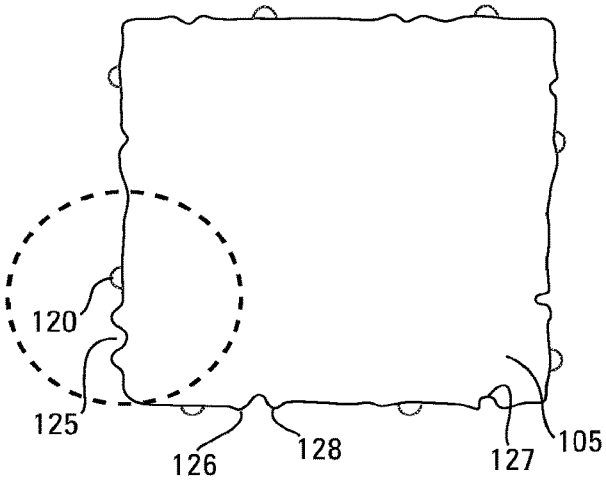

An embodiment of the landscaping or patio block is shown in FIGS. 1 to 7. Block 100 is made of a rugged, weather resistant material; such as zero-slump molded concrete, dry cast concrete and/or wet cast concrete. Other suitable materials include plastic, fiberglass, composite polymers, wood, metal and stone. Block 100 has a block body 110 having parallel top surface 106 and bottom surface 105, first side surface 101, second side surface 102, third side surface 103 and fourth side surface 104. The first, second, third and fourth side surfaces, 101, 102, 103 and 104 respectively, each extend from top surface 106 to bottom surface 105 and may be substantially vertically planar or may have an irregular or non-planar contour. Top surface 106 is formed in a mold box with any desired first texture or pattern, and is shown in FIGS. 1 to 7 having a rough texture or a texture like that of natural stone. The pattern or texture may be formed, imparted, imprinted or applied to the mold in the mold box by a liner, a stripper shoe or any other suitable process as known in the art. It should be understood that patio block 100 may have any desired shape or size and that the features of patio block 100 described herein may be applied to a patio or landscaping block of any shape or size.

Two spacer projections 120 and two spacer locators 125 are positioned on each of the first, second, third and fourth side surfaces 101, 102, 103 and 104, respectively. The spacer projections 120 and spacer locators 125 alternate along the length of the side surface and are spaced a predetermined distance from one another and from the ends of the side surface such that when a first patio block is positioned adjacent a second patio block during the construction of a patio or other desired structure, the spacer projections of any side surface of a first patio block will be guided into and retained by the spacer locators of any side surface of the second patio block and the spacer projections of the side surface of the second patio block will be guided into and retained by the spacer locators of the side surface of the first patio block. Additionally, the spacer projections and spacer locators are positioned along the side surfaces such that when one side surface of a first patio block is positioned adjacent to portions of side surfaces of second and third (or more) patio blocks during the construction of a patio or other desired structure, spacer projections of the side surface of the first patio block will be guided into and retained by the one or more spacer locators of the portions of the side surfaces of the second and third (or more) patio blocks and the one or more spacer projections of the portions of the side surfaces of the second and third (or more) patio blocks will be guided into and retained by the one or more spacer locators of the side surface of the first patio block.

Spacer projections 120 extend outwardly a desired distance from each of the side surfaces and from the block body 110. Spacer projections 120 extend vertically from the bottom surface 105 towards top surface106 any desired distance or length and may extend a partial length of the height of the side surface of the block. It should be understood that each of spacer projections 120 of patio block 100 may have the same height or may have differing heights depending upon the application. Spacer projections 120 may have any desired shape or contour and are shown in FIGS. 1 to 7 having a convex or radial contour. Further, spacer projections 120 may be shaped and sized to be received, either partially or wholly, in a spacer locator 125 in an adjacently positioned block in the construction of a patio as discussed further below. Spacer projections may also have a lower portion 121 and an upper portion 122. Upper portion 122 may taper away or narrow from the lower portion 121 of the spacer projection toward the top surface 106 of the patio block 100. It should be understood that the taper of the upper portion is not limiting as upper portion 122 could have any desired shape or contour and thus could have substantially the same contour as lower portion 121.

Figure 8:
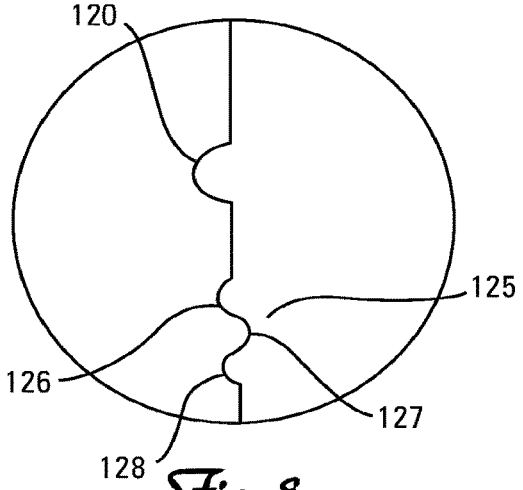
FIGS. 8 to 11 are exploded views of a portion of FIG. 3 showing alternate embodiments of spacer projections and spacer locators for the block of FIGS. 1 to 7.

Spacer locators 125 extend vertically from the bottom surface 105 towards top surface 106 any desired distance or length and may extend the entire height of the side surface of the block. Spacer locators 125 may have any desired shape or contour and are shown having a concave or radial contour. Further, spacer locators 125 may be shaped and sized to receive, either partially or wholly, a locator projection from an adjacently positioned block in the construction of a patio. As best seen in FIG. 8 which is an exploded view of a portion of FIG. 3, spacer locators 125 have a first outward extending portion 126 and a second outward extending portion 128. Locator surface 127 extends from first portion 126 to second portion 128. First and second portions 126 and 128 may each extend outwardly from the side surface and the block body of the patio block at any desired dimension such that the most outwardly extending surfaces of first and second portions 126 and 128 are in a different vertical plane than the side surface of the block. The vertical plane of the most outwardly extending surfaces of first and second portions 126 and 128 are located outside of the block body. Locator surface 127 extends inwardly past the side surface and into the block body from first outward extending portion 126 and second outward extending portion 128 such that the most inwardly extending portion of locator surface 127 is in a different vertical plane than the side surface of the block. The vertical plane of the most inwardly extending portion of locator surface 127 is located inside the block body.

Figure 9:
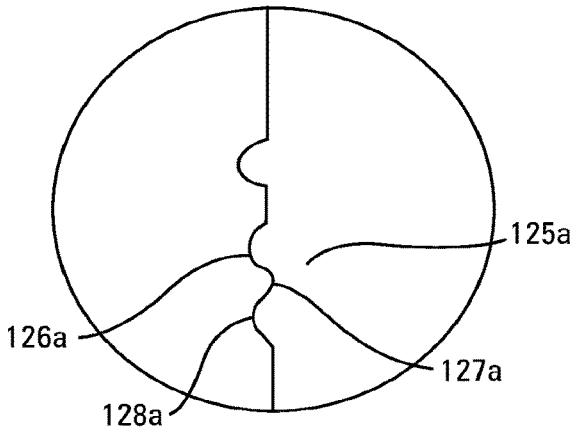
Figure 10:
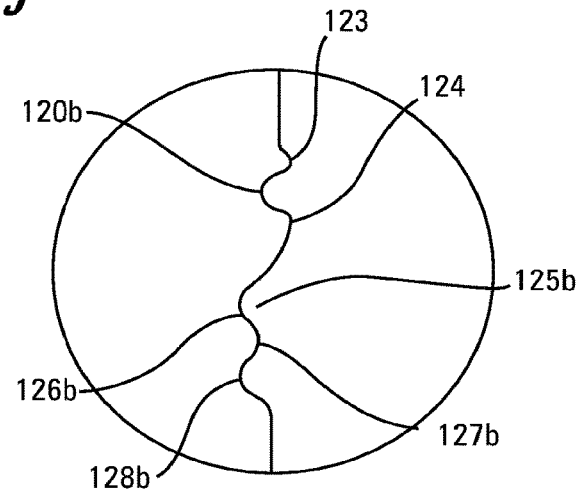
Figure 11:
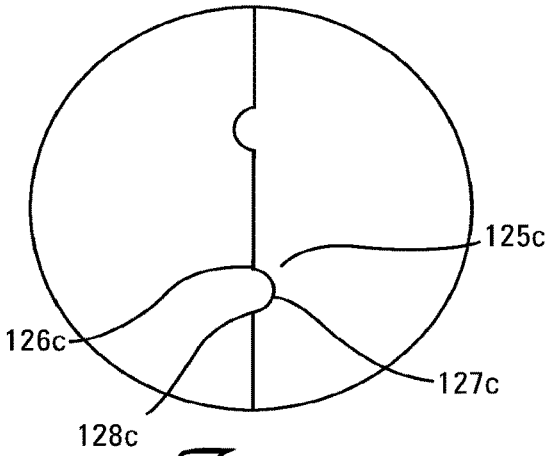

FIGS. 9 to 11 illustrate alternate embodiments of spacer locators 125*a*, 125*b* and 125*c*, respectively shown in exploded views of the partial bottom plan view of FIG. FIG. 9 shows spacer locator 125*a* having locator surface 127*a* extending from first outward extending portion 126*a* to second outward extending portion 128*a*. First and second portions 126*a* and 128*a* each extend outwardly from the side surface and block body of the patio block at any desired dimension. Locator surface 127*a* extends inwardly from first portion 126*a* and second portion 128*a* to the side surface of the block but does not extend into the block body, as such, the most inwardly extending portion of locator surface 127*a* is in the same vertical plane as the side surface of the block.

FIG. 10 shows spacer locator 125*b* having locator surface 127*b* extending from first outward extending portion 126*b* to second outward extending portion 128*b*. First and second portions 126*b* and 128*b* each extend outwardly from the side surface and block body of the patio block at any desired dimension. Locator surface 127*b* extends inwardly from first portion 126*b* and second portion 128*b* toward the side surface of the block but does not extend all the way to the side surface of the patio block such that the most inwardly extending portion of locator surface 127*b* is in a different vertical plane than the side surface of the block. The vertical plane of the most inwardly extending portion of locator surface 127*b* is thus located outside of the block body. FIG. 10 also show spacer projection 120*b* which is an alternate embodiment of spacer projection 120 and has inwardly extending portion 123 and inwardly extending portion 124. Inwardly extending portions 123 and 124 extend into the block body from the side surfaces to the spacer projection such that the spacer projection 120*b* is recessed into the block body from the side surface of the block.

FIG. 11 shows spacer locator 125*c* having locator surface 127*c* extending from first portion 126*c* to second portion 128*c*. First and second portions 126*c* and 128*c* may each be flush or plumb with the side surface and block body of the patio block. Locator surface 127*c* extends inwardly from first portion 126*c* and second portion 128*c* into the block body at any desired dimension.

Figure 12:
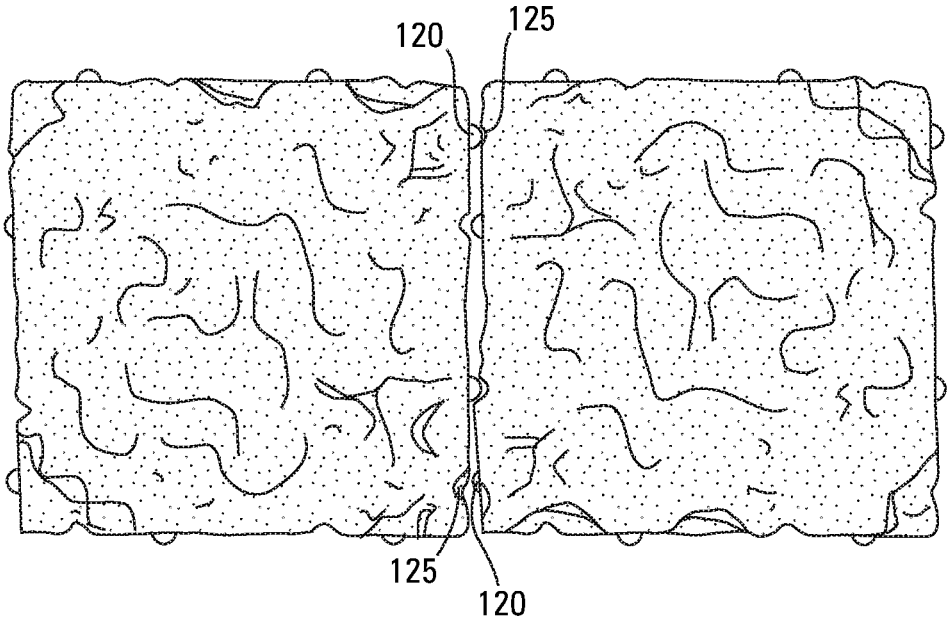
FIGS. 12 and 13 are top and bottom views, respectively, of a patio portion constructed with the blocks of FIGS. 1 to 7.
Figure 13:
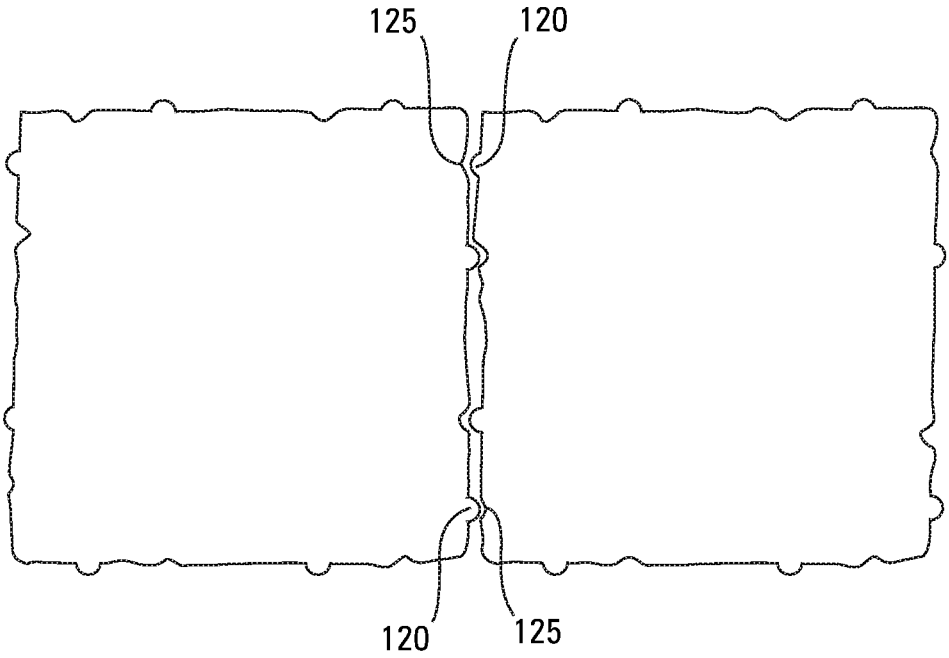
Figure 14:
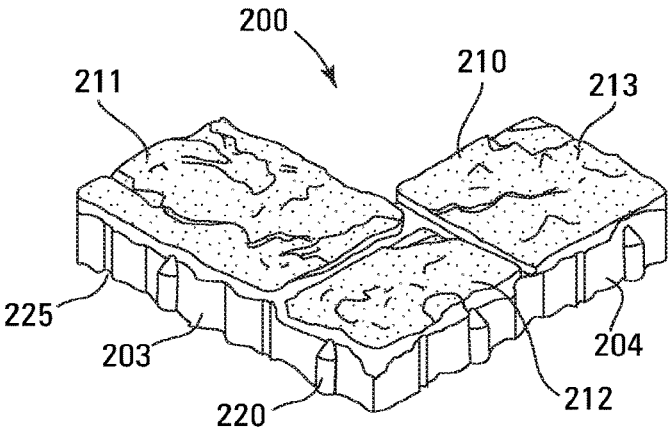
FIGS. 14 to 20 are top perspective, top, bottom and side views, respectively, of an embodiment of a landscaping block.
Figure 15:
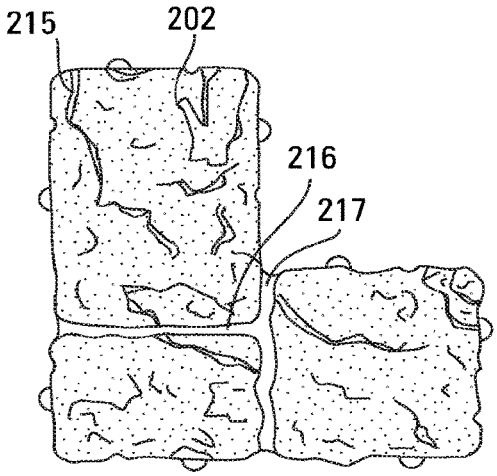
Figure 17:
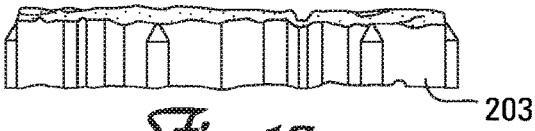
Figure 18:
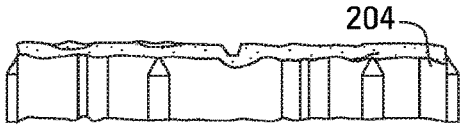
Figure 19:
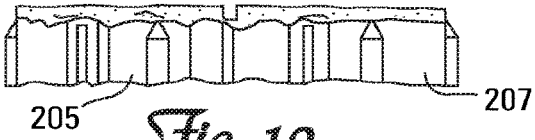
Figure 20:
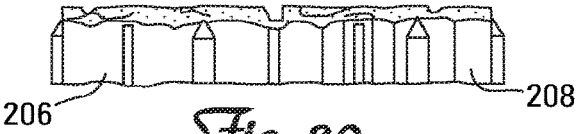
Figure 16:
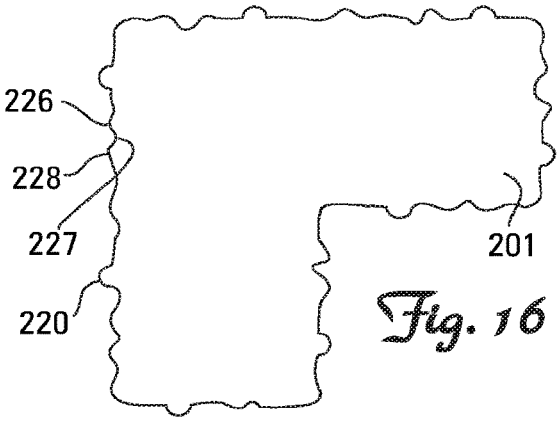

FIGS. 12 and 13 are top and bottom views showing portions of a patio constructed from the blocks of FIGS. 1 to 7. Generally, when constructing a patio, the desired dimensioned area of the patio is excavated to a pre-selected depth and partially filled with a level base of granular material such as crushed stone or sand and is then tampered. The patio blocks are then placed and leveled onto the granular material. The blocks are positioned with top surface 106 facing upward and the bottom surface 105 facing downward. As a first patio block is positioned adjacent a second patio block with one of the side surfaces of the first patio block being adjacent one of the side surfaces of the second patio block, the spacer projections 120 of the first patio block are guided into proper alignment and retained positioning by spacer locators 125 of the second patio block. Additionally, the spacer projections 120 of the second patio blocks are guided into proper alignment and retained positioning by the spacer locators 125 of the first patio block. Spacer projections 120 provide a desired distance or width to be maintained along the joint created by the adjacent positioning of patio blocks relative to one another. This width of the joint created between adjacently positioned patio blocks by spacer projections 120 may or may not correspond to the width of any false joints molded into the top surface of the patio blocks. It should be understood that the width of the joint could have any desired dimension and that the variable range of the width of the joint along the top edges of adjacently positioned blocks could have any desired dimensions and could be in the range of 0.25 cm to 4 cm or 0.5 cm to 2 cm or any other desired range. The irregular contour of the side wall (the side wall being the combination of the side surface, the spacer locators and spacer projections) of the first patio block may have the opposite or mating irregular contour of the side wall of the second patio block such that the side wall contours of the first and second patio block are as puzzle pieces that will not properly nor naturally align or mate until the spacer projections of adjacently positioned first and second patio blocks are guided into the spacer locators of the adjacently positioned first and second patio blocks. Alternatively, the irregular contour of the side wall (the side wall being the combination of the side surface, the spacer locators and spacer projections) of the first patio block may have a non-mating or irregular contour to that of the side wall of the second patio block such that the side wall contours of the first and second patio block will not properly nor naturally align or position until the spacer projections of adjacently positioned first and second patio blocks are guided into the spacer locators of the adjacently positioned first and second patio blocks. As the spacer projections of each adjacently positioned side wall are guided into the spacer locators of each adjacently positioned side wall, the spacer locators accept and retain the spacer projections and prevent slippage, pavement movement, shifting and displacement of the first patio block relative to the second patio block and provide proper and correct alignment of a block relative to adjacently positioned blocks. The natural guiding and mating of the sidewall of the first patio block with the side wall of the second adjacent patio block additionally allows for greater ease during construction of the patio since the positioning of the patio blocks is predetermined by the location of the spacer projections and spacer locators of adjacent patio blocks. Additionally, the spacer projections create a predetermined range of space (joints) between adjacently positioned blocks and the top surfaces of adjacently positioned blocks such that a binding or finishing material such as sand, grout or the like may be inserted into the space between the adjacently positioned blocks to give the patio enhanced aesthetic appeal as well as enhanced strength, durability and stability.

Further, the top surfaces, or features of the top surfaces, of the patio blocks may have irregular contours that may differ from the contour of the side surfaces and sidewalls of the block. These irregular contours of the top surface of a first patio block could cause uneven positioning, slippage, pavement movement and/or shifting relative to the top surface of an adjacent patio block without the guidance and positioning of the spacer projections and spacer locators. Further, the joints between adjacently positioned patio blocks having irregular contoured top surfaces could have widely varying widths that fall out of an acceptable predetermined range without the guidance and positioning of the spacer projections and spacer locators, such that the joint may be too narrow to allow a binding or finishing material to be inserted or too wide as to become structurally unsound/unsafe or visually unpleasing.

FIGS. 14 to 20 show an alternate embodiment of the landscaping or patio block shown in FIGS. 1 to 7. Block 200 has a block body 210 having parallel top surface 202 and bottom surface 201, first side surface 203, second side surface 204, third side surface 205, fourth side surface 206, fifth side surface 207 and sixth side surface 208, such that the block body 210 has an "L" shape. The first, second, third, fourth, fifth and sixth side surfaces each extend from top surface 202 to bottom surface 201 and have an irregular contour appearing more like that of natural stone. It should be understood that the contour of the side surfaces is not limiting as such the side surfaces could have any desired contour and could, for example, be planar.

Top surface 202 has a first shaped area 211, a second shaped area 212 and a third shaped area 213, all of which are the uppermost surfaces of block 200. First area 211, second area 212 and third area 213 form a total upper area 215 of block 200. Top surface 202 may also have recessed surface or false joint 216 that separates first area 211 and second area 212 and may also have recessed surface or false joint 217 that separates second area 212 from third area 213. The first, second and third areas may be formed in a mold box with a roughened texture, a texture like that of natural stone, or any other desired texture or pattern. The pattern or texture may be formed, imparted, imprinted or applied to the mold in the mold box by a liner, a stripper shoe or any other suitable process as known in the art. First area 211, second area 212 and third area 213 may have any desired size or shape as can be seen in alternate embodiments of block 200 in FIGS. 23 to 33. Additionally, the top surface can have any desired number of shaped areas and joints as can be seen in FIG. 31 which shows the total upper area of the top surface having first, second, third and fourth areas and first second and third joints.

As can be seen in FIGS. 14 to 20, two spacer projections 220 and two spacer locators 225 are positioned on first and second side surfaces 203 and 204, respectively. One spacer projection 220 and one spacer locator 225 are positioned on the third, fourth, fifth and sixth side surfaces 205, 206, 207 and 208, respectively. It should be understood that the number of spacer projections and spacer locators on each side surface is not limiting and thus each side surface could have any number of spacer projections and spacer locators as desired. Spacer projections 220 and spacer locators 225 alternate along the length of each of the side surfaces of block 200 and are spaced a predetermined distance from one another and from the ends of each side surface such that when a first patio block is positioned adjacent a second patio block during the construction of a patio or other desired structure, the spacer projections of any side surface of a first patio block will be guided into and retained by the spacer locators of any side surface of the second patio block and the spacer projections of the side surface of the second patio block will be guided into and retained by the spacer locators of the side surface of the first patio block.

Figure 21:
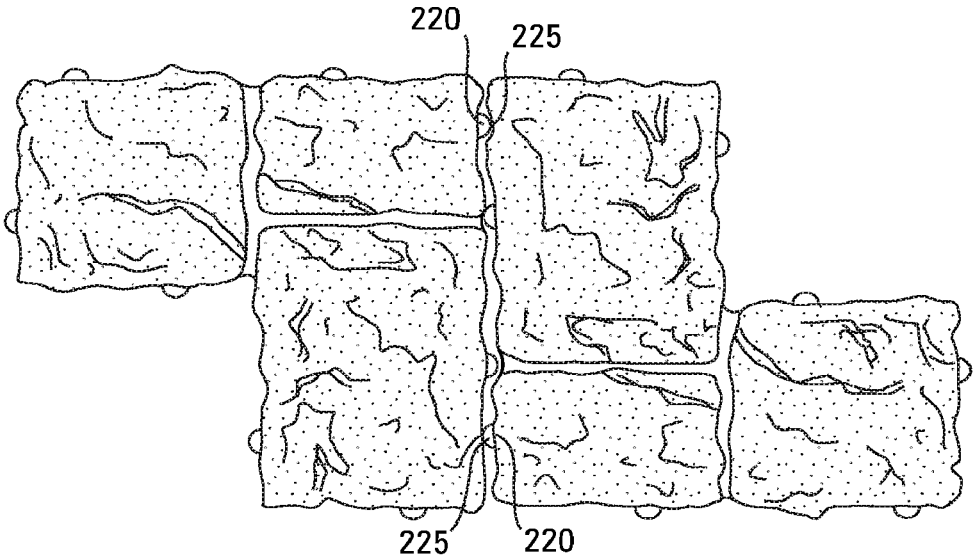
FIGS. 21 and 22 are top and bottom views, respectively, of a patio portion constructed with the blocks of FIGS. 14 to 20.
Figure 22:
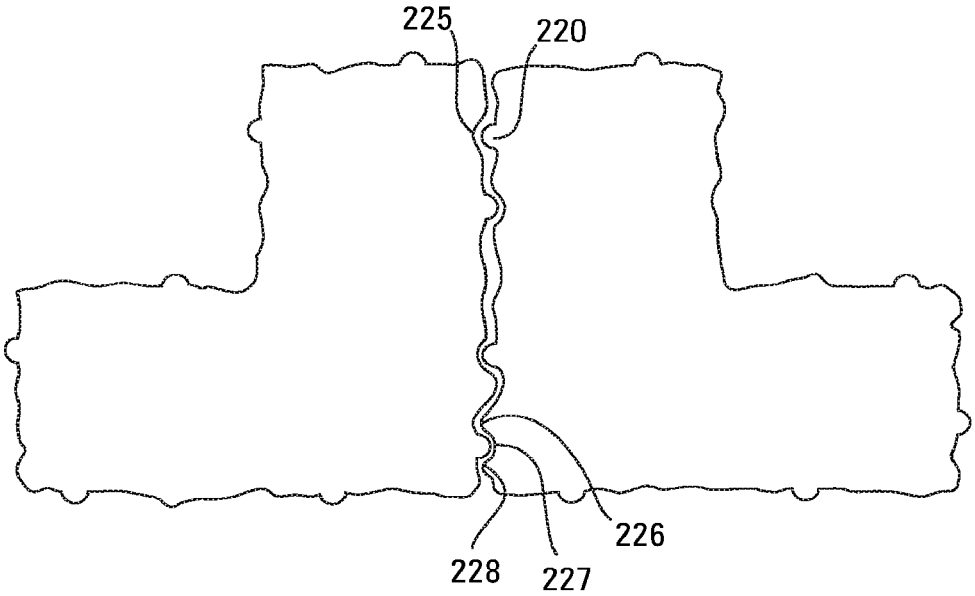
Figure 23:
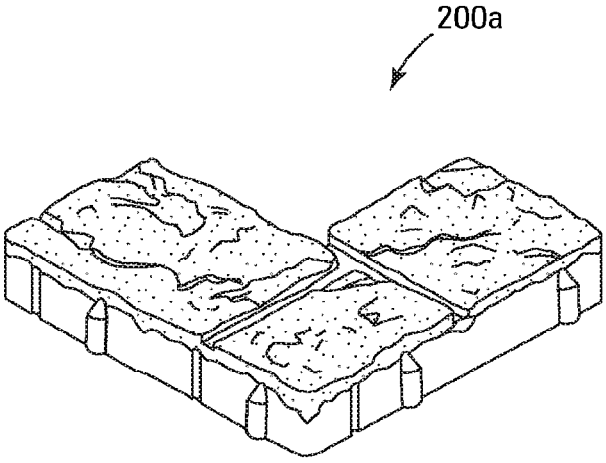
FIGS. 23 to 29 are top perspective, top, bottom and side views, respectively, of an alternate embodiment of the landscaping blocks of FIGS. 14 to 20.
Figure 24:
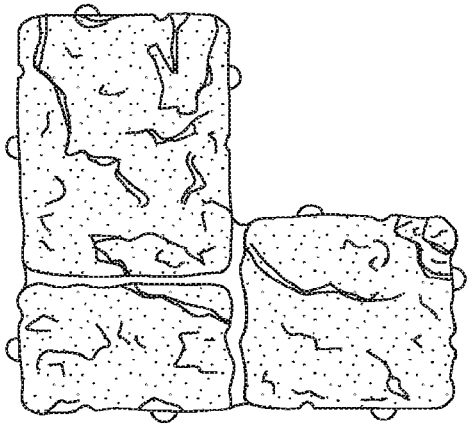
Figure 26:
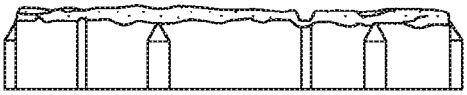
Figure 27:
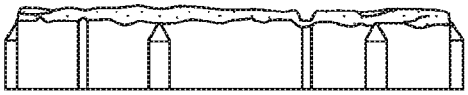
Figure 28:
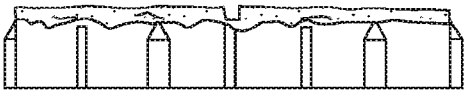
Figure 25:
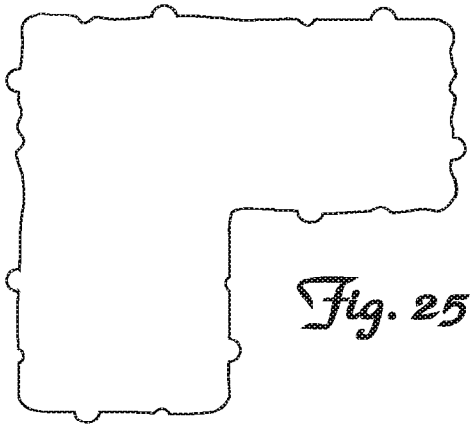
Figure 29:
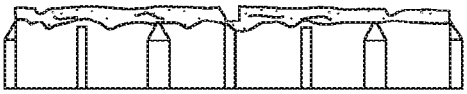

FIGS. 21 and 22 are top and bottom views, respectively, of portions of patios constructed from the blocks of FIGS. 14 to 20. As a first patio block is positioned adjacent a second patio block with one of the side surfaces of the first patio block being adjacent one of the side surfaces of the second patio block, the spacer projections 220 of the first patio block are guided and aligned into the spacer locators 225 of the second patio and the spacer projections 220 of the second patio blocks are guided and aligned into the spacer locators 225 of the first patio block. As the spacer projections of each side wall (the side wall being the combination of the side surface, spacer locators and spacer projections) are guided into the spacer locators of the other side wall, the spacer locators accept and retain the spacer projections and prevent slippage, pavement movement, shifting and displacement of the side wall of the first patio block relative to the side wall of the second patio block and provide proper and correct alignment of the first patio block relative to adjacently positioned blocks. The natural guiding and mating of the spacer projections and spacer locators of the side wall of the first patio block with the spacer projections and spacer locators of the side wall of the second adjacent patio block allows for greater ease in constructing the patio since the positioning of the patio blocks is predetermined by the location of the spacer projections and spacer locators of each side wall of each patio block. The spacer projections create a predetermined joint width or space between the irregularly contoured side surfaces of adjacently positioned blocks and the irregularly contoured top surfaces of adjacently positioned blocks such that a binding or finishing material such as sand, grout or the like may be inserted into the space to give the patio enhanced aesthetic appeal as well as enhanced strength, durability and stability.

Additionally, the irregular contour of each side surface (and top surface) of the first patio block and the irregular contour of each side surface (and top surface) of the adjacently positioned second patio block allow the space between adjacently positioned blocks created by the spacer projection to have variable widths that narrow and widen along the length of the space between blocks. However, the positioning of the spacer projections along the length of each side surface that are retained within the positioned spacer locators in adjacent patio blocks prevents the variable width of the space between blocks from going over a maximum allowed width required by regulatory safety guidelines as outlined in the Americans with Disabilities Act (ADA). Thus the spacer projections and spacer locators keep the variable width of the space between adjacent blocks within an acceptable and predetermined range. Positioning blocks without the spacer projections and spacer locators would result in greatly varied space/distance between adjacent blocks since the irregular contoured side surfaces of adjacent patio blocks would have no natural mating/aligning mechanism. The irregular contour of the adjacently positioned patio blocks would result in at least some portions of the space between adjacently positioned blocks to exceed regulatory ADA safety guidelines. Additionally, blocks not having the spacer projections and mating spacer locators would cause the patio blocks to slip, shift, move or displace during construction, and would reduce the overall functionality, safety and appearance of the patio, while failing to provide proper and correct alignment of a block relative to adjacently positioned blocks.

The predetermined and desired width of the joint created by the spacer projections and spacer locators on the side surfaces of adjacently positioned blocks provide a void or space between blocks for the permeation of water/moisture, and the like, to pass or flow from the top surface of the block to the ground below the patio constructed. Further, the irregularity of the contours of the side surfaces of the block (and as such the perimeter or border of the block) prevent the side surfaces of adjacently positioned patio blocks from aligning completely and abutting one another, further ensuring that spaces or voids in the joints between patio blocks will be maintained throughout the patio constructed. The permeability created by adjacently positioned patio blocks prevents water/moisture from collecting, pooling and/or sitting on the top surface of the patio, providing for a safer, longer lasting and easier to maintain structure. The top surface of the block (along with any false joints in the top surface of the block) may be molded with a slight curve/radius to help direct the water/moisture from the center of the block to the sides of the block and thus into the spaces/voids between adjacently positioned blocks, further enhancing the permeability of the block.

FIGS. 23 to 29 show alternate embodiment 200*a* of landscaping or patio block 200 having less irregularly contoured and more planar side surfaces.

Figure 30:
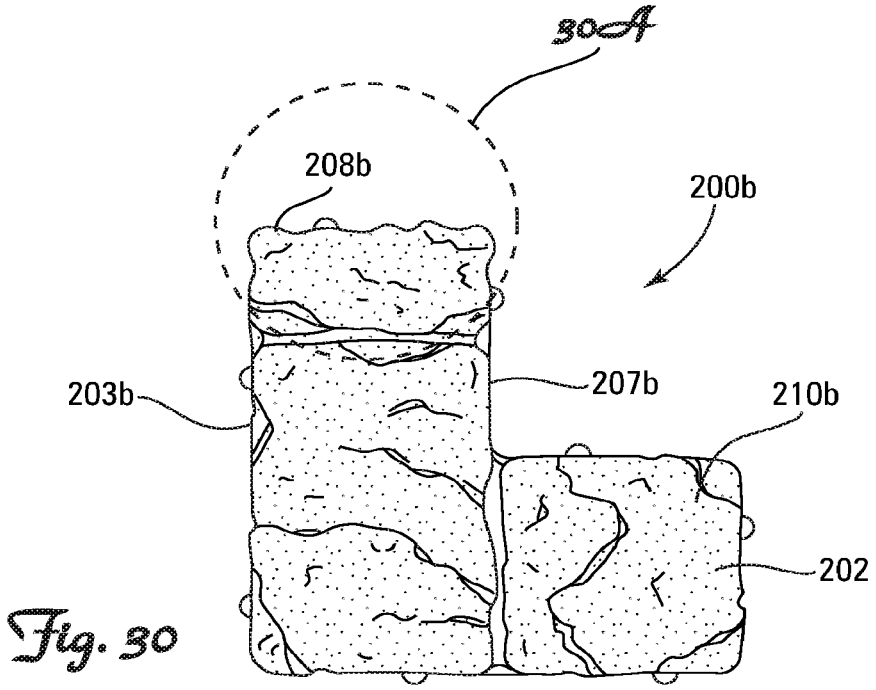
FIGS. 30 to 33 are top views of alternate embodiments of the landscaping block of FIGS. 14 to 20 and 23 to 29.
Figure 30A:
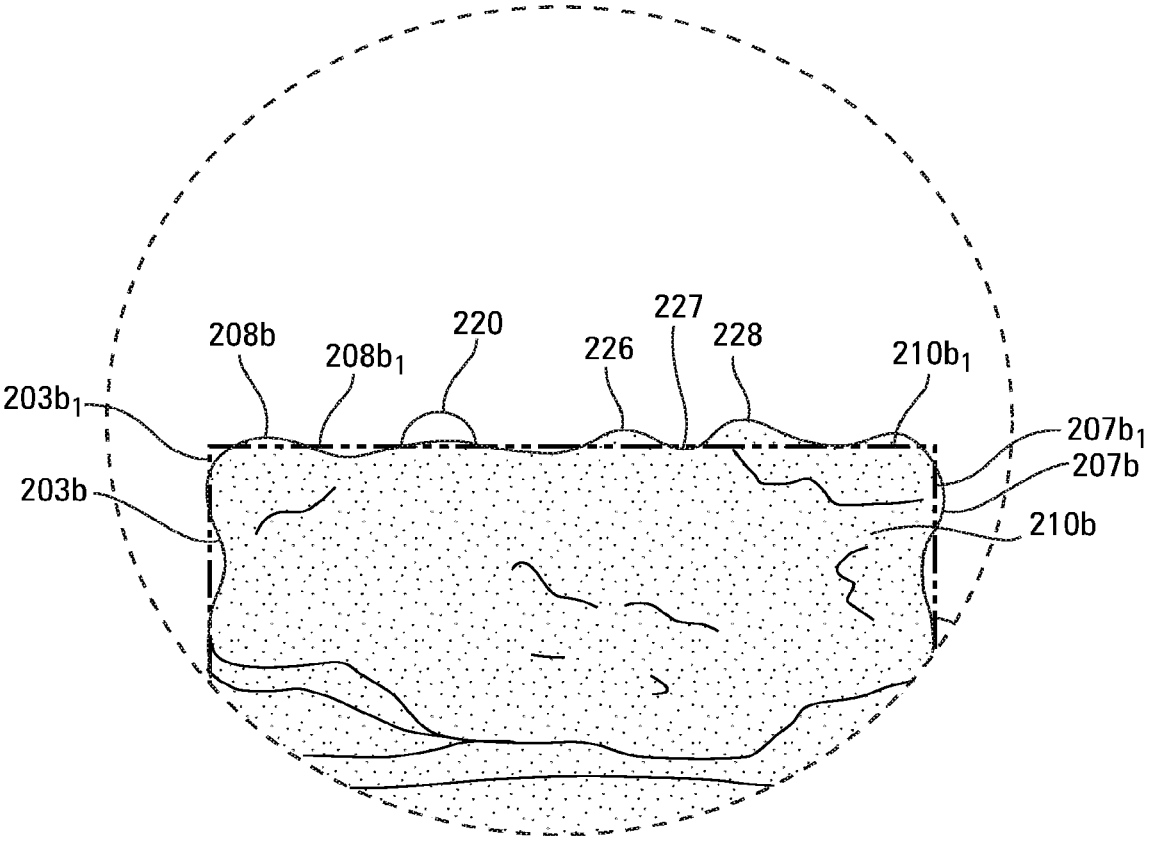
Figure 31:
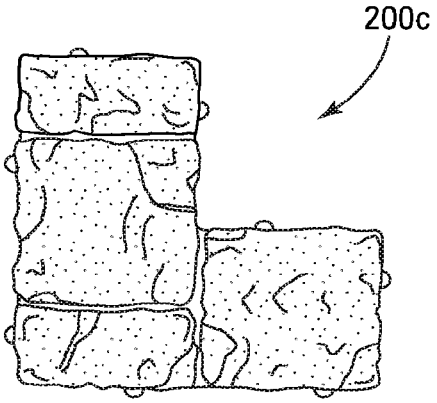

FIG. 30 shows alternate block embodiment 200*b* having a top surface with alternatively placed areas and joints. FIG. 30A shows a more detailed sectional view of the block body 210*b* of block 200*b* along with irregularly contoured side surfaces 203*b*, 207*b*, and 208*b* and irregularly contoured top surface 202.

Averaged planar side surfaces 203$b_1$, 207$b_1$, and 208$b_1$ (along with planar side surfaces 204$b_1$, 205$b_1$, and 206$b_1$ of block body 210*b*, not shown) of FIG. 30A and shown in dashed line represents where a planar surface of each respective irregularly contoured side surface would extend if the values of planar dimensions/locations of the irregularly contoured side surfaces where averaged to express the central or typical valued planar dimension/location of the side surface. As such, there will be portions of the contour of the side surfaces that extend outwardly from the averaged planar surface and there will be portions of the contour of the side surfaces that extend inwardly from the averaged planar surface. The planar side surfaces form the vertically planar border of planar block body 210$b_1$. There will be portions of the contour of the side surfaces of the block that extend outwardly from the planar block body and there will be portions of the contour of the side surfaces that extend inwardly into the planar surface block body. As can be seen in FIG. 30A, the spacer locator, has first outward extending portion 226 and second outward extending portion 228. First and second portions 226 and 228 each extend outwardly from planar side surface 208$b_1$ and planar block body 210$b_1$. Locator surface 227 extends inwardly from first portion 226 and second portion 228 to the planar side surface 208$b_1$ of the planar block body 210$b_1$ but does not extend into the planar block body, as such, the most inwardly extending portion of locator surface 227 is in the same vertical plane as the planar side surface of the planar block body. It should be understood that the dimensions and positioning of locator surface 227 are not limiting and could have any desired dimension or position along the block. As such, locator surface 227 could extends inwardly from first portion 226 and second portion 228 past planar side surface 208$b_1$ of the planar block body 210$b_1$ and into the planar block body so that the most inwardly extending portion of locator surface 227 is in a different vertical plane than the planar side surface and would be located inside of the planar block body. Further, locator surface 227 could extends inwardly from first portion 226 and second portion 228 toward the planar side surface 208$b_1$ of the planar block body 210$b_1$ but could not extend all the way to the planar side surface so that the most inwardly extending portion of locator surface 227 is in a different vertical plane than the planar side surface and would be located outside of the planar block body.

FIG. 30A also shows spacer projection 220 that extend outwardly a desired distance from the planar side surface 208$b_1$ of the planar block body 210$b_1$. It should be understood that the dimensions and positioning of spacer projection 220 are not limiting and could have any desired dimension or position along the block. As such, spacer projection 220 may have inwardly extending surfaces that extend into the planar side surface such that all or a portion of the spacer projection is recessed into the planar side wall and planar block body.

Figure 32:
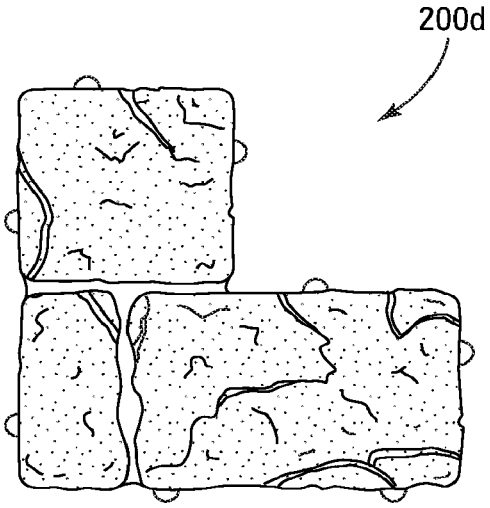
Figure 33:
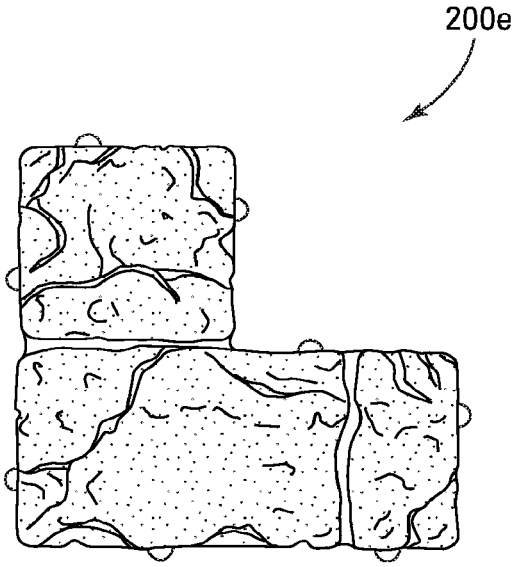

FIG. 31 shows alternate block embodiment 200*c* having a top surface with alternatively placed areas and false joints. FIG. 32 shows alternate block embodiment 200*d* having a top surface with alternatively placed areas and false joints. FIG. 33 shows alternate block embodiment 200*e* having a top surface with alternatively placed areas and false joints.

FIG. 34 shows a top surface of a partial patio constructed with blocks 200*d* and 200*e* positioned adjacently to one another. FIGS. 34A to 34G illustrate alternate embodiments of male spacer projections and female spacer locators shown in exploded views of the partial top plan view of FIG. 34. FIG. 34A shows large male spacer projection 220*a* and female spacer locator 225$a_1$ in the lower portion of the figure having a mating locator surface 227*a* extending from first outward extending portion 226*a* to second outward extending portion 228*a*. FIG. 34A also shows large male spacer projection 220*a* of the first block in contact with smaller male spacer projection 220$a_1$ of the second block where the joint between the adjacently positioned blocks widens due to the contour of the side surfaces of the patio block. This contact between spacer projection 220*a* and spacer projection 220$a_1$ maintains the desired width range of the joint between blocks and keeps proper alignment and positioning of the spacer projections and spacer locators. Without the contact between the spacer projections the block may slip, move, shift or pivot while failing to provide proper and correct alignment of a block relative to adjacently positioned blocks causing the width of the joint to possibly fall out of the desired/safe range.

Figure 34B:
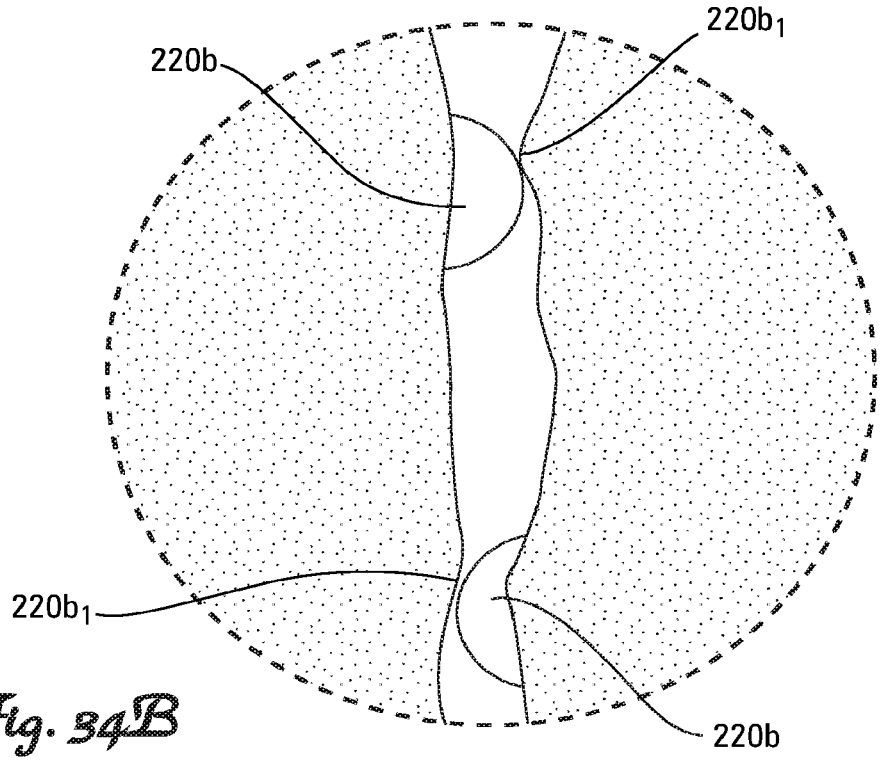

FIG. 34B shows a large male spacer projection 220*b* from each patio block in contact with a smaller male spacer projection 220$b_1$ from each patio block. The positioning of the two sizes of male spacers on the irregular contoured side surfaces of the patio block guide and retain the blocks into a desired position and help maintain a proper distance between the irregular contoured side surfaces of the patio blocks. As such, the two sizes of male spacers projections may guide, retain and position with or without a female spacer locator.

Figure 34C:
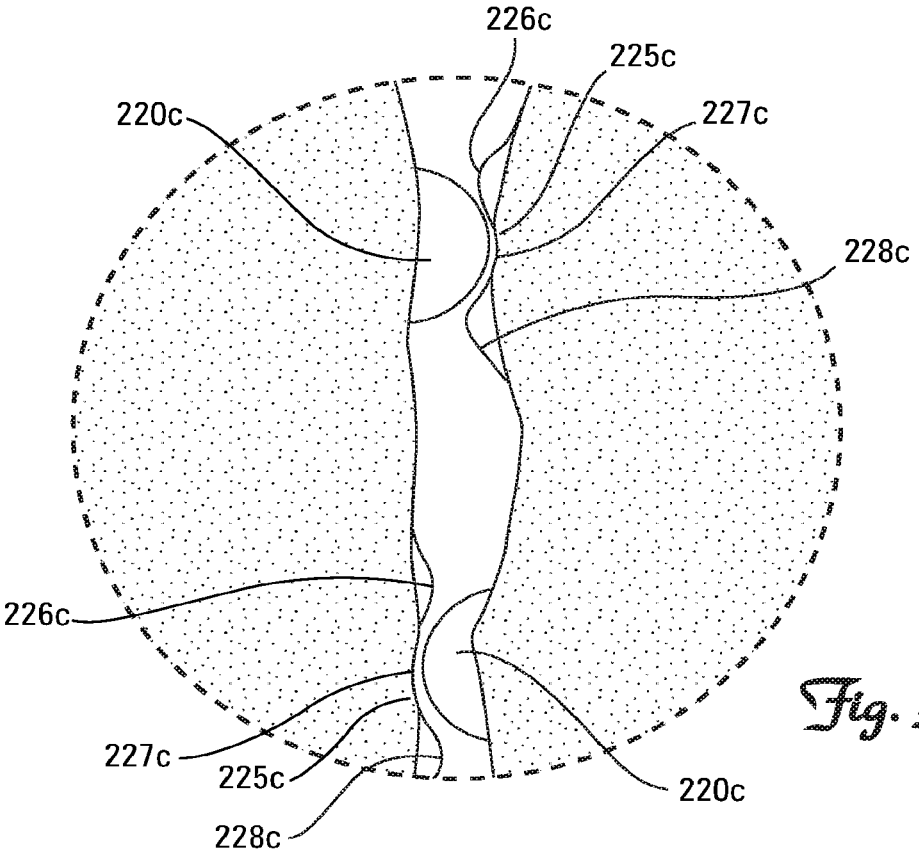

FIG. 34C shows large male spacer projection 220*c* and female spacer locator 225*c* having a mating locator surface 227*c* extending from first outward extending portion 226*c* to second outward extending portion 228*c*.

Figure 34D:
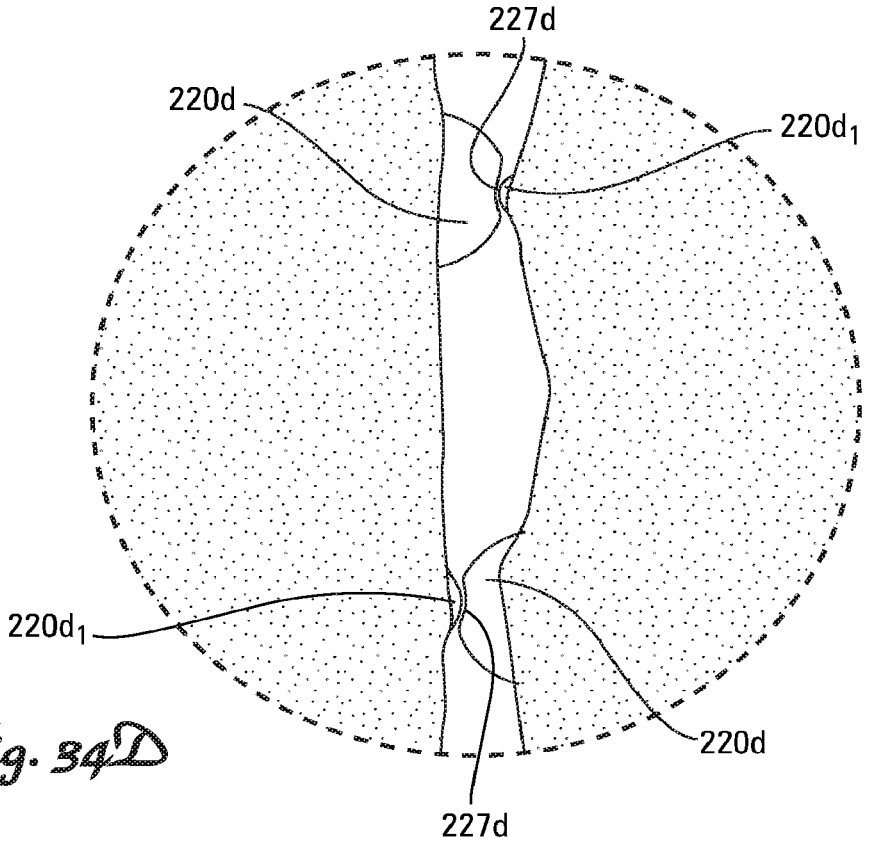

FIG. 34D shows large male spacer projection 220*d* in contact with smaller male spacer projection 220$d_1$. Large male spacer projection 220*d* has female mating surface 227*d* sized to accept smaller male spacer projection 220$d_1$. The mating surface of the larger male spacer projection helps guide the smaller male spacer projection into proper block alignment during the construction of a patio and allows a proper and desired distance to be maintained between adjacent blocks.

Figure 34E:
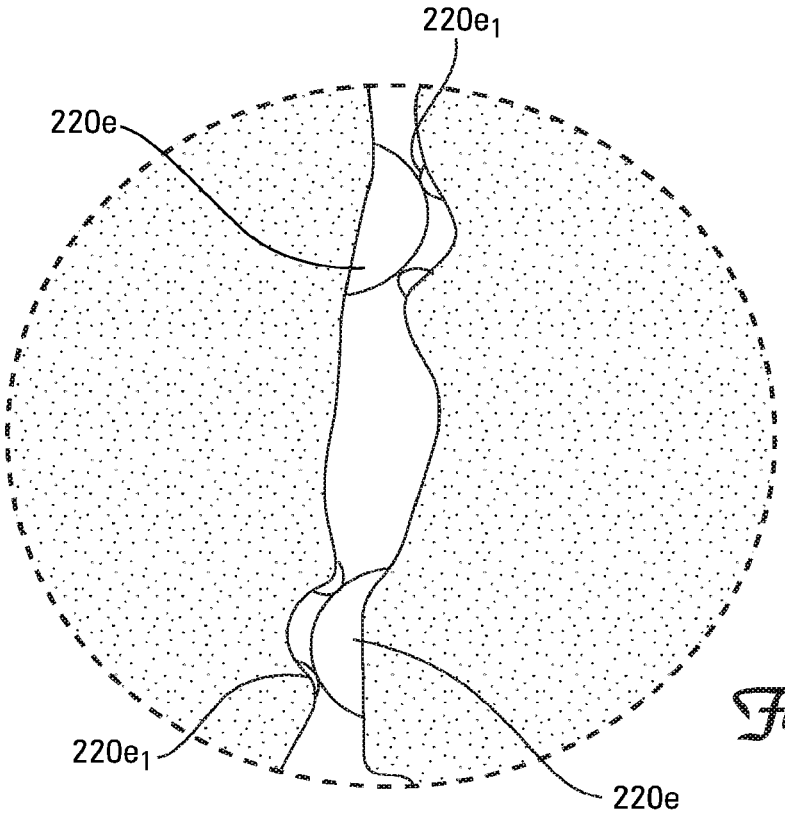

FIG. 34E shows large male spacer projection 220*e* positioned between two smaller male spacer projections 220$e_1$ located in a recess of the irregular contoured side surface of the patio block. The positioning of the two small male projections spacers guide the larger male spacer projections into a desired position and help maintain a proper distance between the irregular contoured side surfaces of the patio blocks.

Figure 34F:
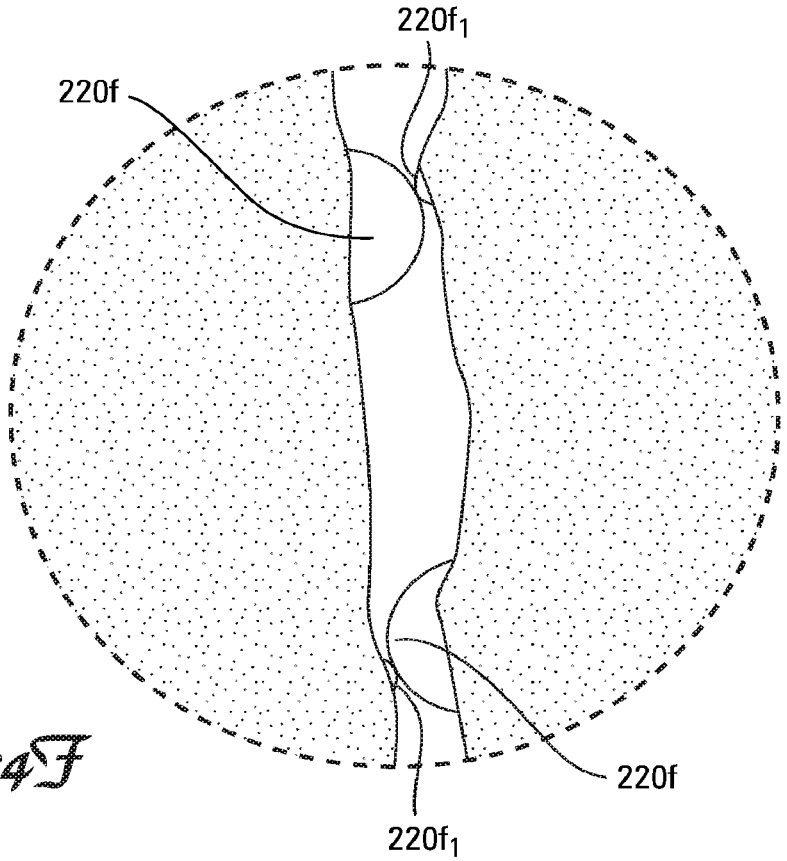

FIG. 34F shows large male spacer projection 220*f* in contact with smaller male spacer projection 220$f_1$ with a first smaller male projection positioned above (relative to the FIG.) the upper large male spacer projection and a second smaller male projection positioned below (relative to the FIG.) the lower large male spacer projection. The location of the two smaller male spacers guide, position and retain the two larger male spacers into a desired position (and thus guide and position the patio blocks) and help maintain a proper distance between the irregular contoured side surfaces of the patio blocks.

Figure 34G:
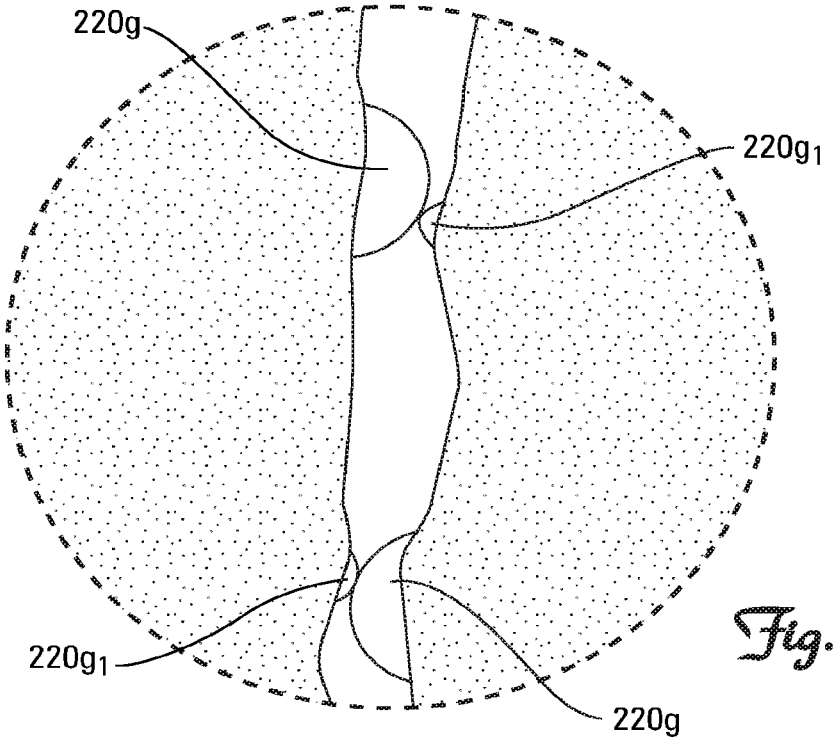

FIG. 34G shows large male spacer projection 220*g* in contact with smaller male spacer projection 220$g_1$ with a first smaller male projection positioned below (relative to the FIG.) the upper large male spacer projection and a second smaller male projection positioned above (relative to the FIG.) the lower large male spacer projection. The location of the two larger male spacers guide, position and retain the two smaller male spacers into a desired position (and thus guide and position the patio blocks) and help maintain a proper distance between the irregular contoured side surfaces of the patio blocks.

Figure 35:
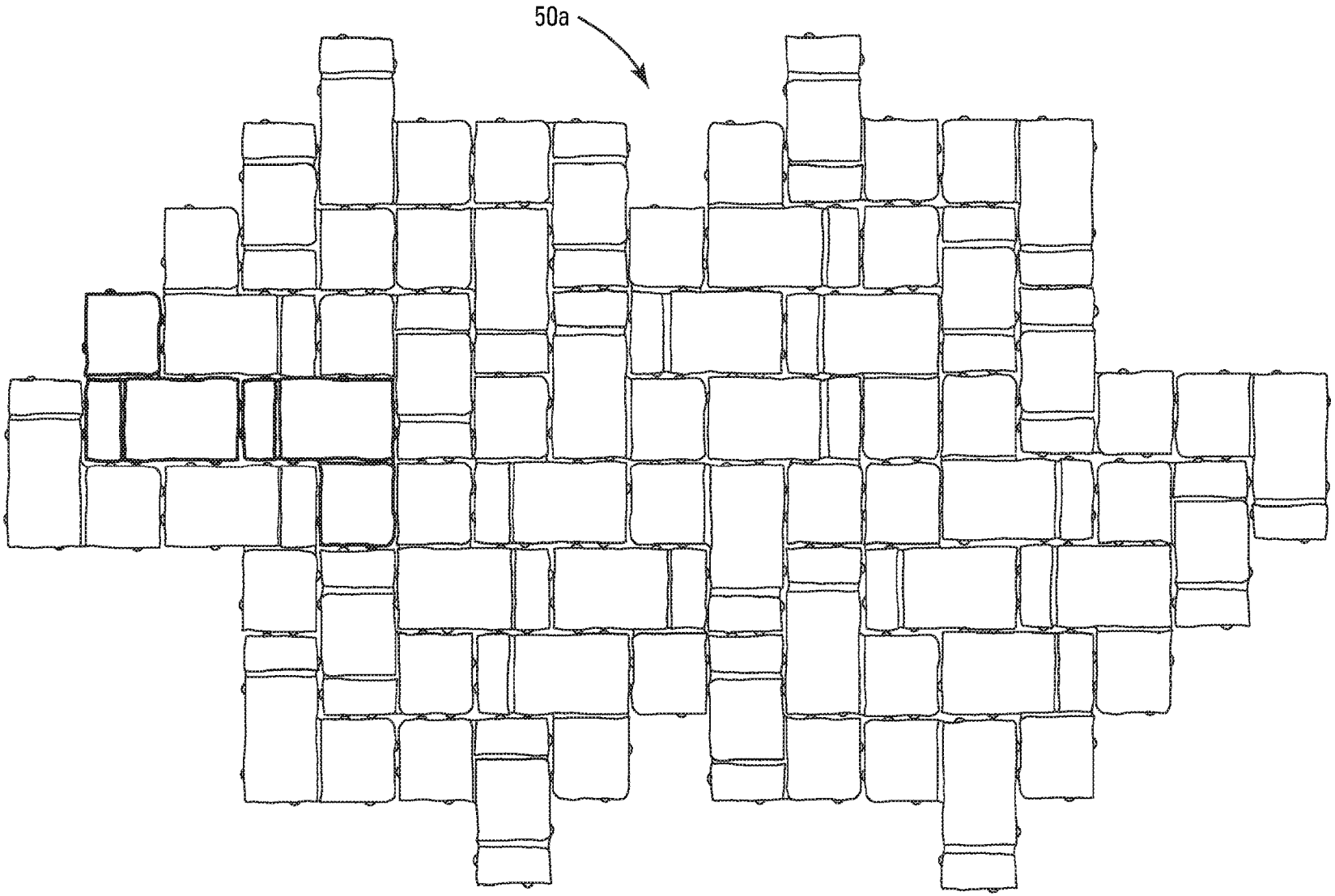
FIGS. 35 to 39 are top views of a different embodiments of patio portions constructed with the blocks of FIGS. 14 to 33.
Figure 36:
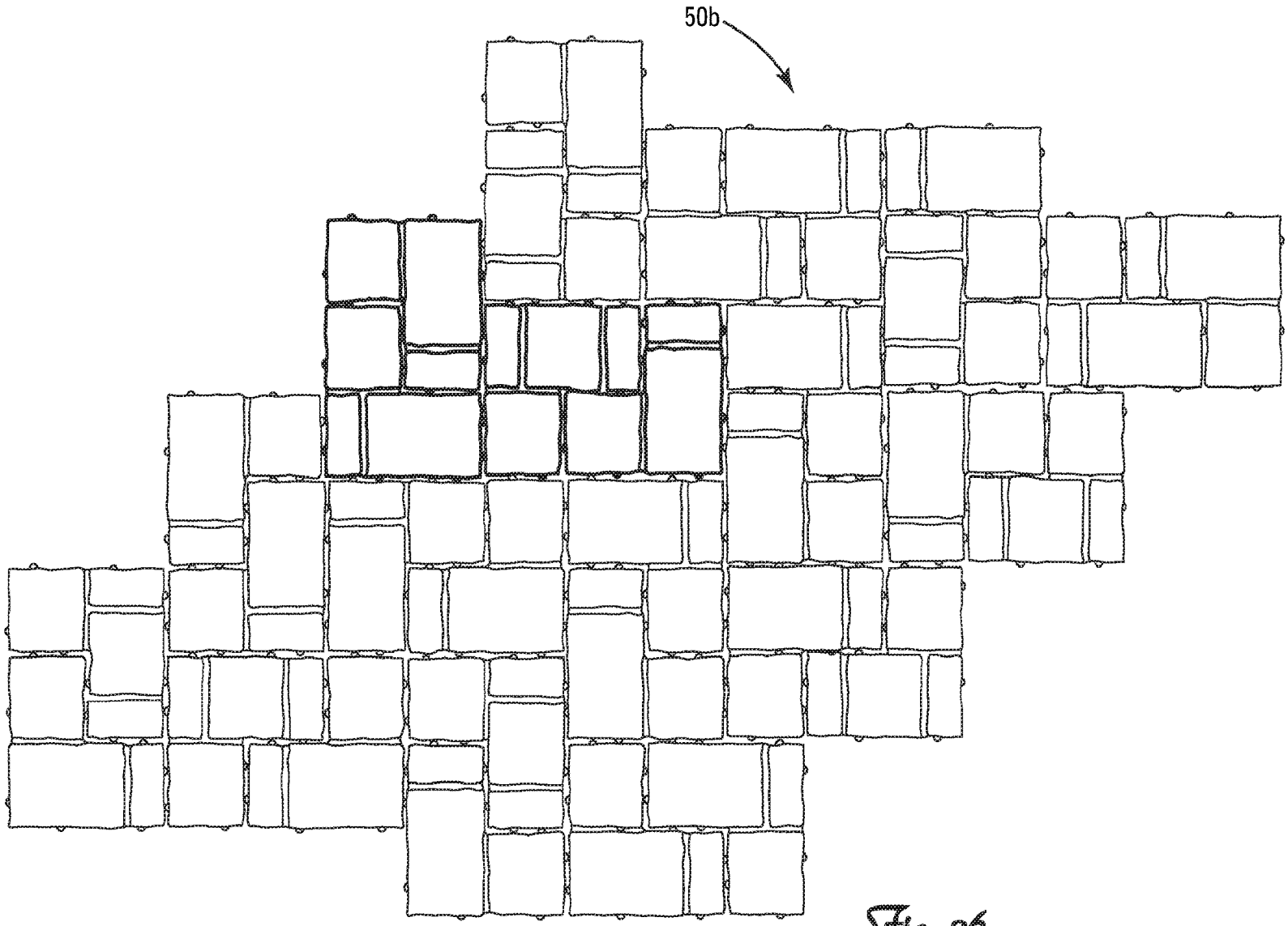
Figure 37:
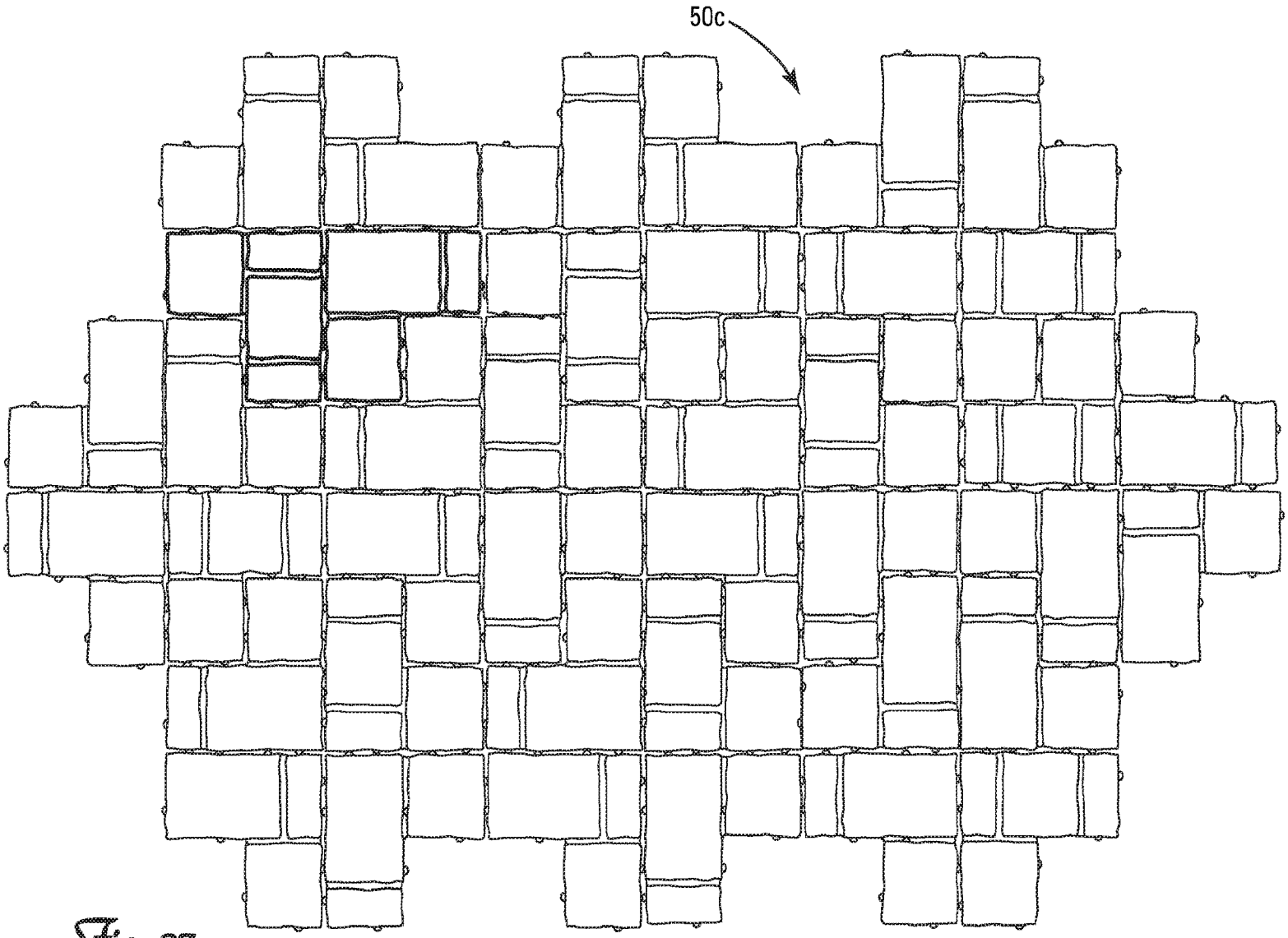
Figure 38:
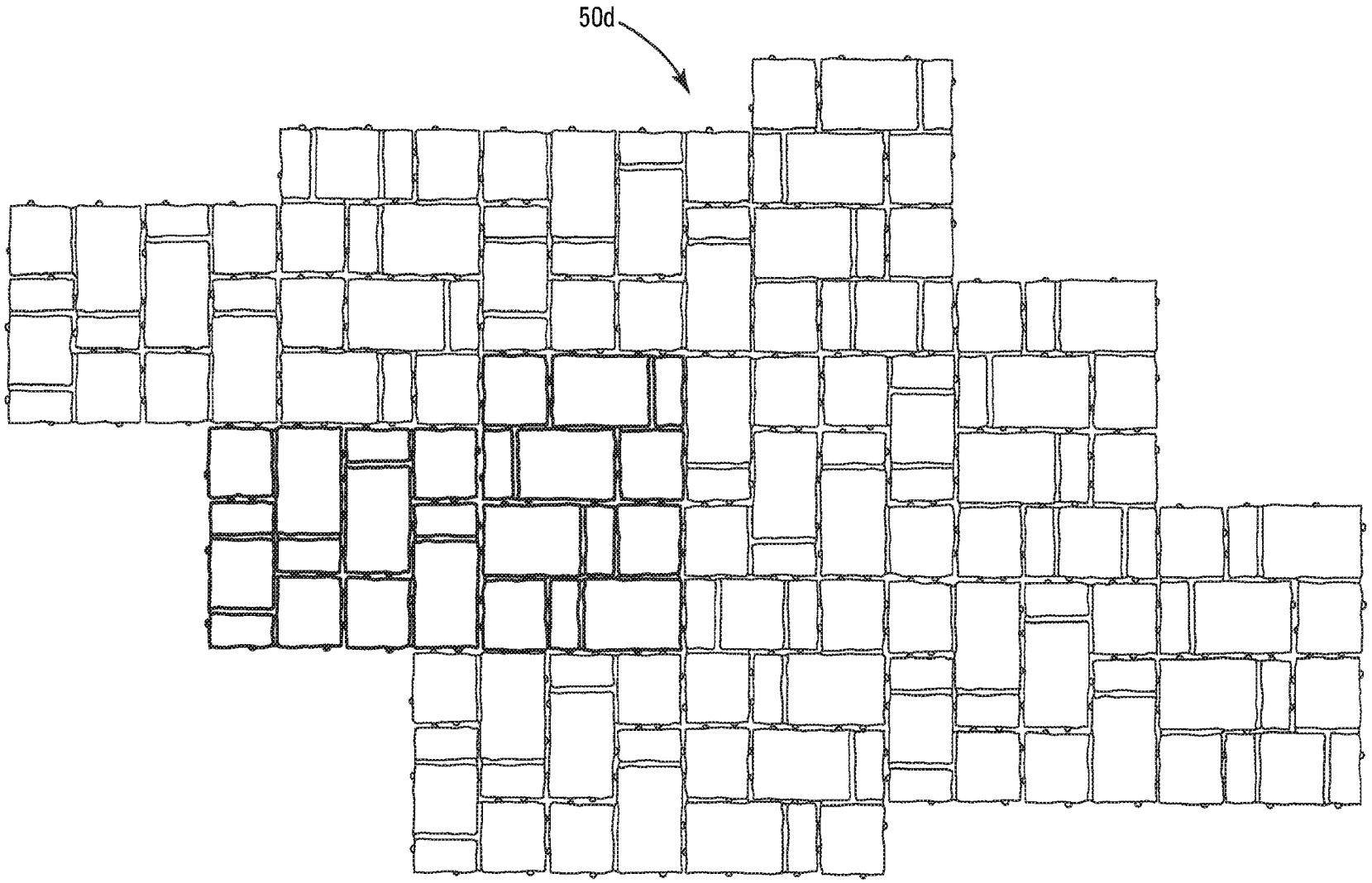
Figure 39:
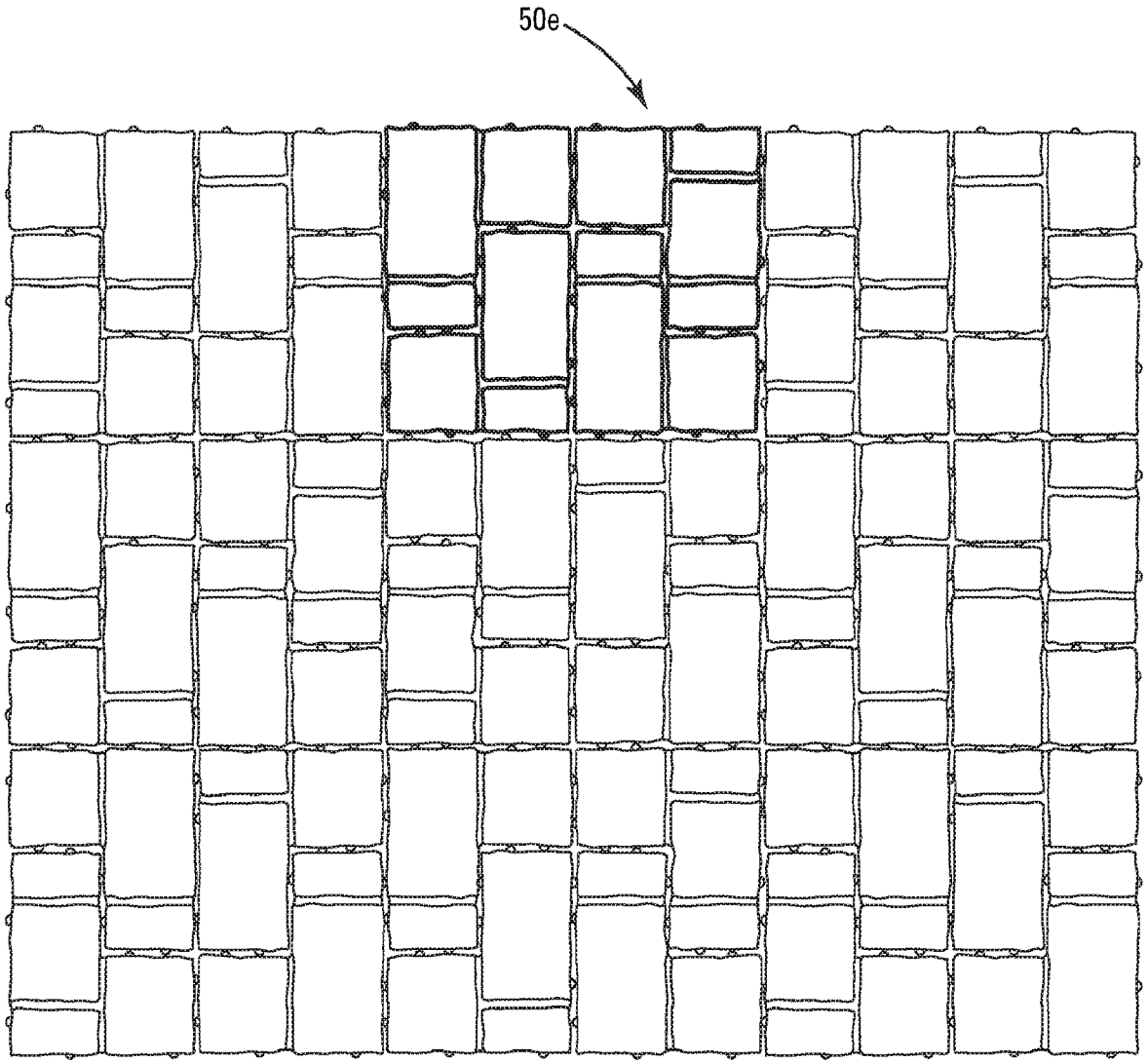
Figure 40:
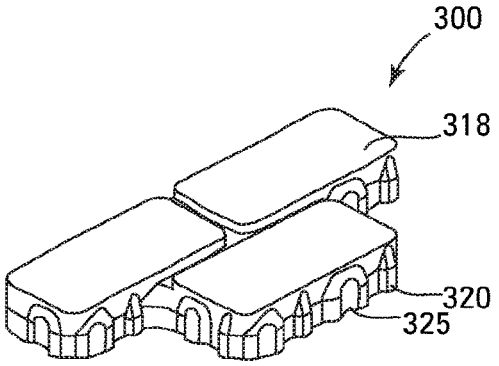
FIGS. 40 to 46 are side top perspective, top, side, bottom and additional side views, respectively, of an embodiment of a landscaping block.
Figure 41:
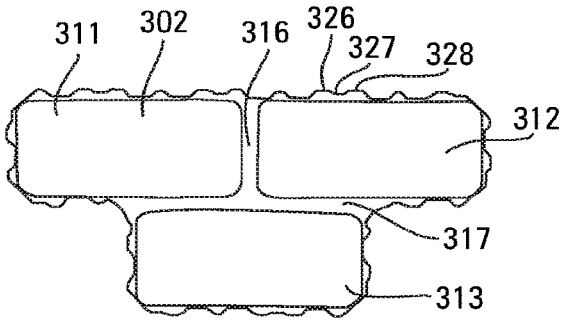
Figure 42:
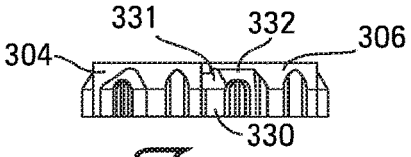
Figure 43:
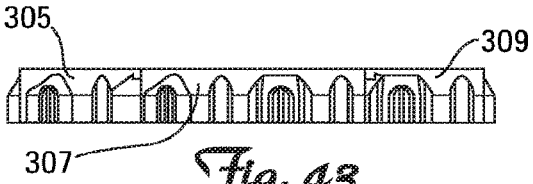
Figure 44:
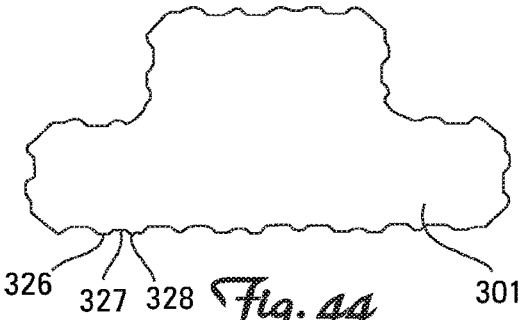
Figure 46:
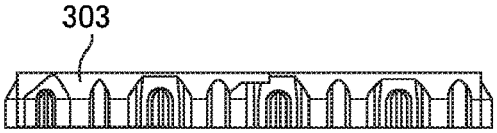
Figure 45:
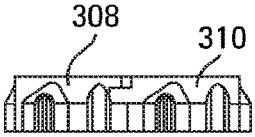

FIGS. 35 to 39 are portions of patios constructed with the blocks of FIGS. 14 to 33. FIG. 35 shows a portion of a patio utilizing a single unit herringbone pattern. FIG. 36 shows a portion of a patio utilizing a herringbone rectangle pattern. FIG. 37 shows a portion of a patio utilizing a stacked bond rotated rectangle pattern. FIG. 38 shows a portion of a patio utilizing a rotated rectangle pattern. FIG. 39 shows a portion of a patio utilizing a stacked bond rectangle pattern.

FIGS. 40 to 46 show alternate block embodiment 300. Block 300 has a block body 318 having parallel top surface 302 and bottom surface 301, first side surface 303, second side surface 304, third side surface 305, fourth side surface 306, fifth side surface 307, sixth side surface 308, seventh side surface 309 and eighth side surface 310 such that the block body 318 has a "T" shape. The first, second, third, fourth, fifth, sixth, seventh and eighth side surfaces each extend from top surface 302 to bottom surface 301 and may be substantially planar. It should be understood that the contour of the side surfaces is not limiting and the side surfaces could have any desired contour and could, for example, be irregular or non-planar.

Top surface 302 has a first area 311, a second area 312 and a third area 313, all of which are the uppermost surfaces of block 300. First area 311, second area 312 and third area 313 may be on the same horizontal plane and form a total upper area 315 of block 300. Top surface 302 may also have recessed surface or false joint 316 that separates first area 311 from second area 312 and may also have recessed surface or false joint 317 that separates third area 313 from first area 311 and second area 312. The first, second and third areas may be formed in a mold box with a rough texture, a texture like that of natural stone, a pattern or any other desired texture. The pattern or texture may be formed, imparted, imprinted or applied to the mold in the mold box by a liner, a stripper shoe or any other suitable process as known in the art.

Figure 49:
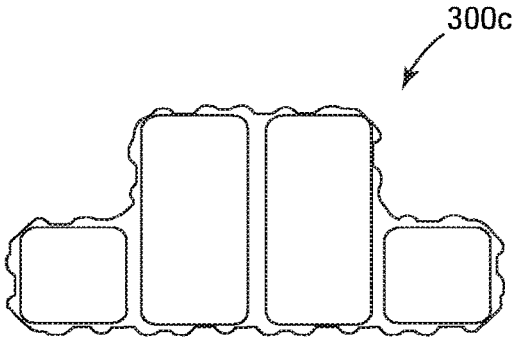
Figure 50:
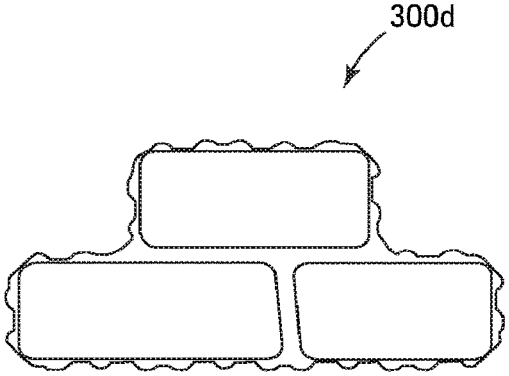
Figure 51:
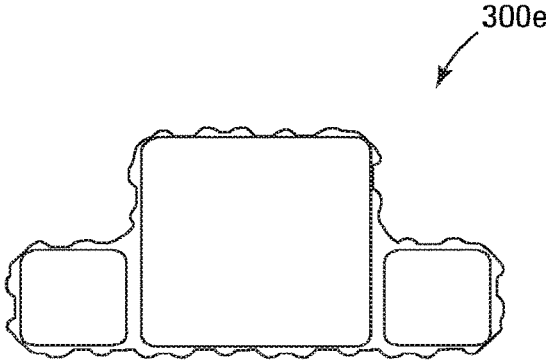
Figure 52:
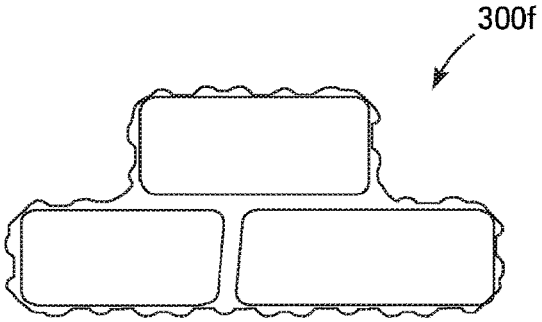

First area 311, second area 312 and third area 313 may have any desired size or shape as can be seen in alternate embodiments of block 300 in FIGS. 50 to 52. Further, the number of areas may vary and top surface 302 of block 300 could have one to four or more areas and one to three or more false joints separating the areas from one another as seen in alternate embodiments of block 300 in FIGS. 47 to 49.

As can be seen in FIGS. 40 to 46, first side surface 303 has four spacer projections 320 and four spacer locators 325; second, third, fourth, sixth, seventh and eighth side surfaces 304, 305, 306, 308, 309 and 310, respectively, each have one spacer projection 325 and one spacer locator 320; and fifth side surface 307 has two spacer projections 320 and two spacer locators 325. It should be understood that the number of spacer projections and spacer locators on each side surface is not limiting and thus each side surface could have any number of spacer projections and spacer locators as desired. It should further be understood that the size, shape and contour of the spacer projections and spacer locators are not limiting and thus each could have any desired size, shape and contour.

Spacer locators 325 have a first outward extending portion 326 and a second outward extending portion 328. Locator surface 327 extends from first portion 326 to second portion 328. First and second portions 326 and 328 may each extend outwardly from the side surface and block body of the patio block at any desired dimension. Locator surface 327 extends inwardly a partial distance toward the side surface from first outward extending portion 326 and second outward extending portion 328 such that the most inwardly extending portion of locator surface 327 is in a different vertical plane than the side surface of the block. Locator surface 327 may or may not extend all the way to the side surface of the block or into the block body from first and second outward extending portions 326 and 328 such that the most inwardly extending portion of locator surface 327 may be in a vertical plane outside or inside of the block body 318 or may be in a the same vertical plane as the side wall. Spacer locators 325 have a lower portion 330 and an upper portion 331. Upper portion may taper from the lower portion toward the top surface of the block. Additionally, upper portion 331 may have an uppermost edge 332 that abuts the side surface. Uppermost edge 332 may have any desired contour and may, for example, have an irregular contour.

During construction of a patio with block 300, a first patio block is positioned adjacent one or more additional patio blocks with one or more side surfaces of the first patio block being placed adjacent to at least a portion of one or more side surfaces of the one or more additional patio blocks. Spacer projections 320 of the first patio block are guided, aligned and retained into the spacer locators 325 of the adjacently positioned one or more additional patio blocks and the spacer projections 320 of the one or more additional patio blocks are guided, aligned and maintained into the spacer locators 325 of the adjacent first block.

Figure 47:
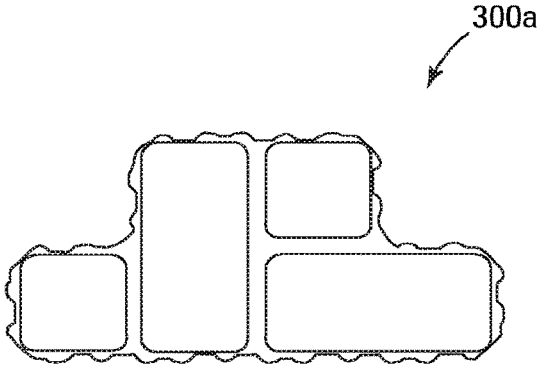
FIGS. 47 to 52 are top views of alternate embodiments of the landscaping block of FIGS. 40 to 46.
Figure 48:
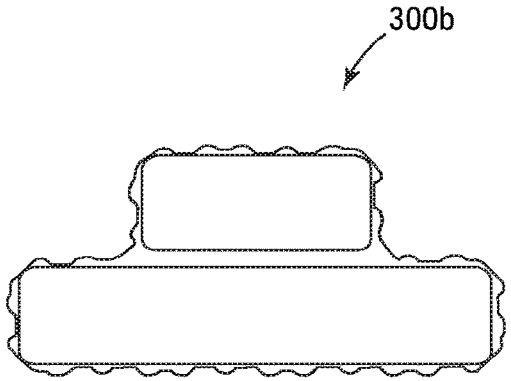

FIG. 47 shows alternate block embodiment 300*a* with the top surface having four shaped areas and three false joints. FIG. 48 shows alternate block embodiment 300*b* with the top surface having two shaped areas and one false joint. FIG. 49 shows alternate embodiment 300*c* with the top surface having four shaped areas and three false joints. FIG. 50 shows block embodiment 300*d* having alternatively shaped and sized shaped areas and false joints. FIG. 51 shows alternate embodiment 300*e* having alternatively shaped and sized shaped areas and false joints. FIG. 52 shows alternate embodiment 300*f* having alternatively shaped and sized shaped areas and false joints.

Although particular embodiments have been disclosed herein in detail, this has been done for purposes of illustration only, and is not intended to be limiting with respect to the scope of the appended claims, which follow. In particular, it is contemplated by the inventor that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A patio block comprising:

a block body having opposed top and bottom surfaces, and at least a first side surface, a second side surface, a third side surface and a fourth side surface, each of the at least first, second, third and fourth side surfaces extending from the top surface to the bottom surface;

at least one first size spacer projection positioned along irregularly contoured portions of each one of the at least first, second, third and fourth side surfaces, the at least one first size spacer projection extending outwardly from the at least first, second, third and fourth side surfaces, the at least one first sized spacer projection having a contour;

at least two second size spacer projections positioned along irregularly contoured portions of each one of the at least first, second, third and fourth side surfaces, the at least two second size spacer projections extending outwardly from the at least first, second, third and fourth side surfaces, the first size spacer projection being larger in size than the second size spacer projections;

wherein one of the at least two second sized spacer projections is positioned along at least one of the side surfaces a distance from the other of the at least two second sized spacer projections forming a length between the two second sized spacer projections, the length being sized to accept at least a portion of the contour of the first size spacer projection between the two second size spacer projections.

2. The patio block of claim 1, wherein the first and second size spacer projections of each side surface extend a partial height of the side surface from the bottom surface toward the top surface of the patio block.

3. The patio block of claim 2, wherein the first and second size spacer projections of each side surface extend the entire height of the side surface from the bottom surface to the top surface of the patio block.

4. The patio block of claim 1, further comprising:

a recessed surface positioned along irregularly contoured portions of each one of the at least first, second, third and fourth side surfaces, the recessed surface having a contour, wherein two second sized spacer projections are positioned along the contour of the recessed surface of at least one of the side surfaces and wherein the length of the distance between the two second sized spacer projections along the recessed surface is sized to accept at least a portion of the contour of the first size spacer projection.

5. The patio block of claim 4, wherein the distance between the two second sized spacer projections positioned along the recessed surface of at least one of the side surfaces forms a spacer locator that has a contoured surface shaped to accept at least a portion of the contour of the first size spacer projection.

6. The patio block of claim 4, wherein a portion of the contour of the recessed surface of at least one of the side surfaces extends beyond the side surface and is located outside of the block body.

7. The patio block of claim 4, wherein the entire contour of the recessed surface of at least one of the side surfaces extends into the block body.

8. The patio block of claim 4, wherein the length between the two second sized spacer projections along the recessed surface is sized to prevent at least a portion of the contour of the first size spacer projection from contacting at least a portion of the contour of the recessed surface.

9. The patio block of claim 1, wherein the block body has a fifth and sixth side surface such that the block body has an "L" shape, wherein the patio block has at least one first sized spacer projection and at least two second sized spacer projections positioned along each of the fifth and sixth side surfaces.

10. A patio system comprising:

a plurality of patio blocks, the patio blocks having a block body with opposed top and bottom surfaces, and at least a first side surface, a second side surface, a third side surface and a fourth side surface each extending from the top surface to the bottom surface, each of the at least first, second, third and fourth side surfaces having an irregular contour such that top and bottom edges along the top and bottom surfaces where the at least first, second, third and fourth side surfaces extend also have an irregular contour, at least one first size spacer projection positioned along each one of the at least first, second, third and fourth side surfaces, the at least one first size spacer projection extending outwardly from the at least first, second, third and fourth side surfaces, the at least one first sized spacer projection having a contour; at least two second size spacer projections positioned along each one of the at least first, second, third and fourth side surfaces, the at least two second size spacer projections extending outwardly from the at least first, second, third and fourth side surfaces, the first size spacer projection being larger in size than the second size spacer projections wherein one of the at least two second sized spacer projections is positioned along at least one of the side surfaces a distance from the other of the at least two second sized spacer projections forming a length between the two second sized spacer projections, the length being sized to accept at least a portion of the contour of the first size projection between the two second sized spacer projections; and wherein when a patio is made with the plurality of patio blocks, the length between the second sized spacers projections receives the first size spacer projection such that when a side surface of a first patio block is laid adjacent to a side surface of a second patio block the first sized spacer projection of the side surface of the first patio block is accepted and retained into the length between the second sized spacer projections of the second patio block preventing displacement of the first patio block relative to the adjacent second patio block and creating a joint between the first patio block and the second patio block, the joint having variable widths along the length of the adjacent portions of the irregularly contoured top edges of the first and second patio block.

11. The patio block system of claim 10, wherein the plurality of patio blocks have a recessed surface positioned along portions of each one of the at least first, second, third and fourth side surfaces, the recessed surface having a contour, and wherein two second sized spacer projections are positioned along the contour of the recessed surface of at least one of the side surfaces and wherein the length of the distance between the two second sized spacer projections along the recessed surface is sized to accept at least a portion of the contour of the first size spacer projection.

12. The patio block system of claim 11, wherein the distance between the two second sized spacer projections positioned along the recessed surface of at least one of the side surfaces of the plurality of patio blocks forms a spacer locator that has a contoured surface shaped to accept at least a portion of the contour of the first size spacer projection.

13. The patio block system of claim 11, wherein a portion of the contour of the recessed surface of at least one of the side surfaces of the plurality of patio blocks extends beyond the side surface and is located outside of the block body.

14. The patio block system of claim 11, wherein the length between the two second sized spacer projections along the recessed surface of at least one of the side surfaces of the plurality of blocks is sized to prevent at least a portion of the contour of the first size spacer projection from contacting at least a portion of the contour of the recessed surface.

15. The patio block system of claim 10, wherein the block body of the plurality of patio blocks has a fifth and sixth side surface such that the block body has an "L" shape, wherein the patio block has at least one first sized spacer projection and at least two second sized spacer projections positioned along each of the fifth and sixth side surfaces.

16. A method of making a patio comprising:

providing a plurality of patio blocks, the patio blocks having a block body with opposed top and bottom surfaces, and at least a first side surface, a second side surface, a third side surface and a fourth side surface each extending from the top surface to the bottom surface, each of the at least first, second, third and fourth side surfaces having an irregular contour such that top and bottom edges along the top and bottom surfaces where the at least first, second, third and fourth side surfaces extend also have an irregular contour, at least one first size spacer projection positioned along each one of the at least first, second, third and fourth side surfaces, the at least one first size spacer projection extending outwardly from the at least first, second, third and fourth side surfaces, the at least one first sized spacer projection having a contour, at least two second size spacer projections positioned along each one of the at least first, second, third and fourth side surfaces, the at least two second size spacer projections extending outwardly from the at least first, second, third and fourth side surfaces, the first size spacer projection being larger in size than the second size spacer projections wherein one of the at least two second sized spacer projections is positioned along at least one of the side surfaces a distance from the other of the at least two second sized spacer projections forming a length between the two second sized spacer projections, the length being sized to accept at least a portion of the contour of the first size projection between the two second sized spacer projections; and forming a patio by positioning the patio blocks with a side surface of a first patio block laid adjacent to a side surface of a second patio block such that the first sized spacer projection of the side surface of the first patio block is accepted and retained into the length between the two second sized spacer projections of the second adjacent patio block preventing displacement of the first patio block relative to the adjacent second patio block and creating a joint between the first patio block and the second patio block, the width of the joint having variable dimensions along the length of the adjacent portions of the irregularly contoured top edges of the first and second patio block.

17. The method of claim 16, wherein the plurality of patio blocks have a recessed surface positioned along portions of each one of the at least first, second, third and fourth side surfaces, the recessed surface having a contour, and wherein two second sized spacer projections are positioned along the contour of the recessed surface of at least one of the side surfaces and wherein the length of the distance between the two second sized spacer projections along the recessed surface is sized to accept at least a portion of the contour of the first size spacer projection.

18. The method of claim 17, wherein the distance between the two second sized spacer projections positioned along the recessed surface of at least one of the side surfaces of the plurality of patio blocks forms a spacer locator that has a contoured surface shaped to accept at least a portion of the contour of the first size spacer projection.

19. The method of claim 17, wherein the length between the two second sized spacer projections along the recessed surface of at least one of the side surfaces of the plurality of blocks is sized to prevent at least a portion of the contour of the first size spacer projection from contacting at least a portion of the contour of the recessed surface.

20. The method of claim 16, wherein the block body of the plurality of patio blocks has a fifth and sixth side surface such that the block body has an "L" shape, wherein the patio block has at least one first sized spacer projection and at least two second sized spacer projections positioned along each of the fifth and sixth side surfaces.

* * * * *